US006433652B1

(12) United States Patent
Hattori et al.

(10) Patent No.: US 6,433,652 B1
(45) Date of Patent: Aug. 13, 2002

(54) MULTIMODE DIELECTRIC RESONATOR APPARATUS, FILTER, DUPLEXER AND COMMUNICATION APPARATUS

(75) Inventors: Jun Hattori, Takatsuki; Shin Abe, Muko; Hiroki Wakamatsu, Kyoto; Tomoyuki Ise, Nagaokakyo, all of (JP)

(73) Assignee: Murata Manufacturing Co., Ltd. (JP)

( * ) Notice: Subject to any disclaimer, the term of this patent is extended or adjusted under 35 U.S.C. 154(b) by 0 days.

(21) Appl. No.: 09/718,727

(22) Filed: Nov. 22, 2000

(30) Foreign Application Priority Data

Nov. 24, 1999 (JP) ..... 11-333404

(51) Int. Cl.[7] ..... H01P 1/213; H01P 1/20

(52) U.S. Cl. ..... 333/134; 333/202; 333/219.1; 333/222

(58) Field of Search ..... 333/134, 219, 333/219.1, 202, 222

(56) References Cited

U.S. PATENT DOCUMENTS 5,059,929 A * 10/1991 Tanaka ..... 333/219.1
5,859,574 A * 1/1999 Schmitt ..... 333/202
6,104,261 A * 8/2000 Sonoda et al. ..... 333/202

FOREIGN PATENT DOCUMENTS

EP 1014474 6/2000 ..... H01P/7/10
WO 99/12225 3/1999 ..... H01P/7/10

OTHER PUBLICATIONS

European Search Report issued Mar. 8, 2001 in a related application (In English).

Patent Abstracts of Japan, vol. 1995, Jun. 16, 1995 & JP 07 154116 A (Murata Mfg. Co. Ltd.),Jun. 16, 1995.

Ji–Fuh Liang, et al., "Mixed Modes Dielectric Resonator Loaded Cavity Filters," IEEE MTT–S International Microwave Symposium Digest, US, New York, IEEE May 23, 1994, pp. 731–734, XP000516654.

ValéMadrangeas, et al., "Analysis and Realization of L–Band Dielectric Resonator Microwave Filter," IEEE Transactions on Microwave Theory and Techniques, US, IEEE Inc. New York, vol. 40, No. 1, 1992, pp. 120–127, XP000244297.

* cited by examiner

*Primary Examiner*—Robert Pascal
*Assistant Examiner*—Dean Takaoka
(74) *Attorney, Agent, or Firm*—Ostrolenk, Faber, Gerb & Soffen, LLP

(57) ABSTRACT

A multimode dielectric resonator apparatus is configured such that a TM mode and a TE mode are transformed into multiplex modes, coupling between individual resonant modes can be easily made, and a large number of sequentially coupled stages for a single dielectric core can be obtained. A dielectric core is configured of a plate-like TM-mode dielectric core portion and a TE-mode dielectric core portion protruding therefrom asymmetrically in the upper and lower directions. By this asymmetry of the TE-mode dielectric core portion with respect to the TM-mode dielectric core portion, for example, a TMx mode and a TEz mode may be coupled together, and concurrently, a TMy mode and a TEz mode may be coupled together.

14 Claims, 22 Drawing Sheets

FIG. 4A
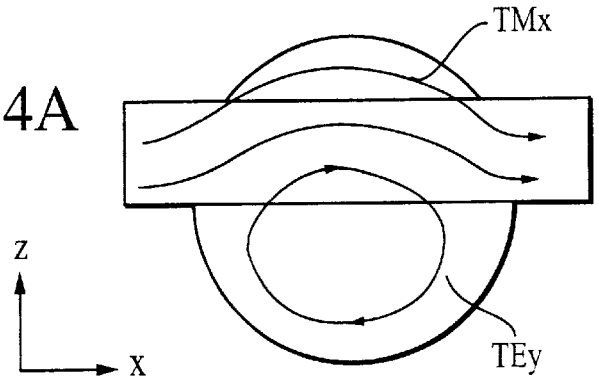
FIG. 4B
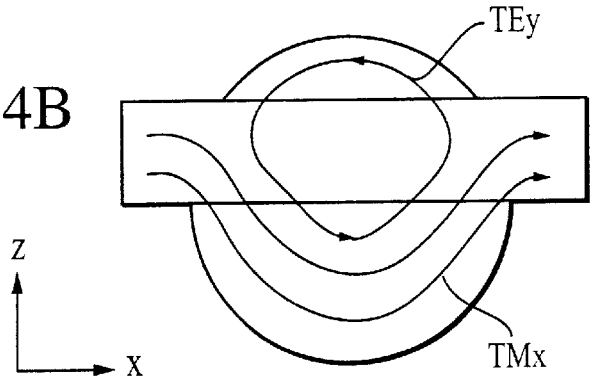
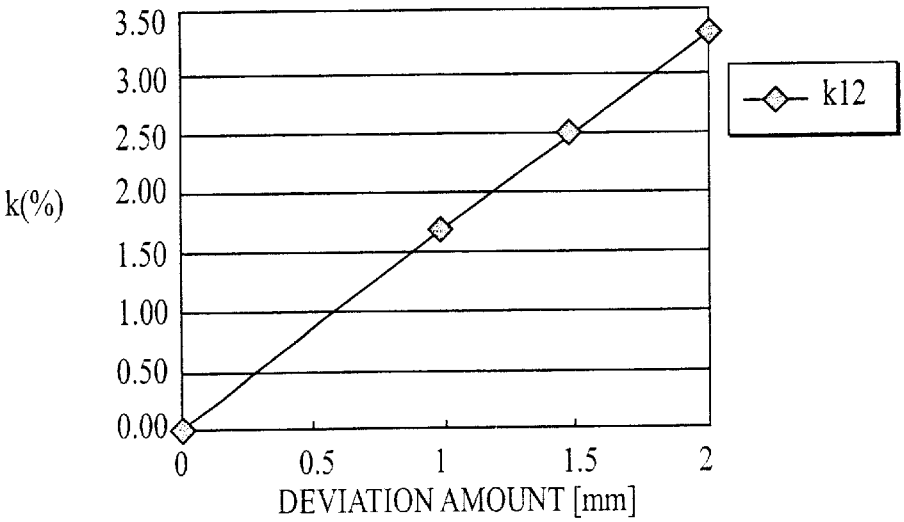
FIG. 5

MULTIMODE DIELECTRIC RESONATOR APPARATUS, FILTER, DUPLEXER AND COMMUNICATION APPARATUS

CROSS-REFERENCE TO RELATED APPLICATION

This is related to Ser. No. 09/718,555 filed by the same inventors on even date herewith, titled MULTIMODE DIELECTRIC RESONATOR APPARATUS, FILTER, DUPLEXER AND COMMUNICATION APPARATUS, pending, the disclosures of which are incorporated by reference herein.

BACKGROUND OF THE INVENTION

1. Field of the Invention

The present invention relates to a multimode dielectric resonator apparatus that operates in multiple resonant modes, to a filter and a duplexer that use the resonator, and to a communication apparatus that uses the filter and/or the duplexer.

2. Description of the Related Art

Conventionally, a dielectric resonator having a dielectric core arranged in a cavity uses a mode such as a TE01δ mode or a TM01δ mode. In a configuration of a multistage dielectric resonator apparatus formed using the aforementioned dielectric resonators, a plurality of the dielectric cores are provided in a cavity.

In the aforementioned configuration using the single resonant mode generated in the single dielectric core, however, the overall size increases in proportion to the increase in the number of resonators. In addition, the plurality of dielectric cores must be positioned and fixed with high accuracy. This makes it difficult to manufacture dielectric resonator apparatuses, such as dielectric filters, having consistent characteristics.

The present applicant has submitted Japanese Unexamined Patent Application Publication No. 11-145704, regarding a dielectric resonator apparatus in which, while a single dielectric core is used, the multiplex number is increased. The dielectric resonator apparatus according to the above application is arranged such that, when resonant spaces are represented by x, y, and z rectangular coordinates, TMx, TMy, and TMz modes are generated in which electric-field vectors extend toward the individual x, y, and z axes, and TEx, TEy, and TEz modes are generated in which electric-field vectors form loops in the plane directions perpendicular to the individual x, y, and z axes. At most six modes can thereby be used.

In the multimode dielectric resonator apparatus according to the above-described patent application, to couple predetermined resonant modes to each other, either grooves or an opening are provided in a portion in which electric fields of two modes that will be coupled together are concentrated, perturbations are applied to the electric fields in that portion, and energy is thereby transferred between the two resonant modes. However, when the TM mode and the TE mode are coupled together in the described construction, the two modes interact perpendicular to each other, so secure coupling cannot be easily obtained. The coupling grooves or openings must be deeply formed to obtain secure coupling therebetween. However, since electric-field distributions of the individual resonant modes are thereby diverged, problems are caused in that the resonant frequencies are increased, and in addition, adjustment of the filter characteristics is difficult.

SUMMARY OF THE INVENTION

In view of the above problems, the present invention provides a multimode dielectric resonator apparatus that allows TE modes and TM modes to be securely coupled to each other without increasing the resonant frequencies and that allows the filter characteristics to be easily adjusted.

The invention also provides a filter using the aforementioned multimode dielectric resonator apparatus.

The invention further provides a duplexer that uses the aforementioned multimode dielectric resonator apparatus.

The invention also provides a communication apparatus using the above.

According to one aspect of the present invention, a multimode dielectric resonator apparatus is configured in a dielectric resonator apparatus formed by arranging a dielectric core in a conductive cavity. The dielectric core is configured of a TM-mode dielectric core portion for primarily determining resonant frequencies of TM modes so that at least one of the TM modes resonates in an operating frequency band, and other TM modes resonate at frequencies higher than the operating frequency band; and a TE-mode dielectric core portion for primarily determining resonant frequencies of TE modes so that individual ones of multiple TE modes resonate in the operating frequency band. Either the shapes of the TM-mode dielectric core portion and the TE-mode dielectric core portion, or support structures therefor, are arranged asymmetrically, and predetermined TM modes and TE modes are coupled to each other so that, in areas where electric fields of the predetermined TM-modes are distributed, TE-mode electric fields are generated, having the same directional components as those of the electric fields of the TM modes.

As described above, although neither grooves nor openings are provided for coupling the TM modes and the TE modes, secure coupling can be obtained according to the arrangement in which the TM modes and the TE modes are coupled together without causing their resonant frequencies to increase. In addition, characteristic adjustment can be easily implemented according to the arrangement made such that divergences that can be caused by the coupling grooves or openings in electric-field distributions in the individual modes are reduced; that is, according to the arrangement made such that the coupling structures between the TM modes and the TE modes do not influence other resonant modes, characteristic adjustment can be easily implemented.

In the multimode dielectric resonator apparatus, the TM-mode dielectric core portion is formed to have a platelike shape, the TE-mode dielectric core portion is formed to have a shape protruding from an upper face and a lower face of the platelike portion. Also, the TM-mode dielectric core portion and the TE-mode dielectric core portion are arranged asymmetrically; that is, there is a difference between the upper-side protruding amount and the lower-side protruding amount. With this construction, the asymmetry can be easily arranged; the TM-mode electric-field distribution areas and TE-mode electric-field distribution areas can be separated to minimize the area in which the TM-mode electric field and the TE-mode electric field overlap; and the design procedure can therefore be simplified.

The protruding parts may have any shape as long as the five modes of interest (TMx, TMy, TMz, TEx, TEy) have substantially the same resonant frequency. For example, in a quintuple mode filter for the 2 GHz band, the respective resonant frequencies should be within about 0.1 MHZ of each other.

According to another aspect of the invention, dielectric members for supporting the TM-mode dielectric core portion and the TE-mode dielectric core portion in the cavity are arranged asymmetrically with respect to the dielectric core. That is, the support structures of the TM-mode dielectric core portion and the TE-mode dielectric core portion have asymmetry. With the asymmetry thus arranged using the support members that support the dielectric core in the cavity, the dielectric core is arranged to be asymmetric, so that the manufacture thereof can be facilitated. In addition, the divergences in the electromagnetic-field distributions in other modes whose resonant frequencies are outside the operating frequency band can be minimized.

According to a further aspect of the invention, in the multimode dielectric resonator apparatus, the TM-mode dielectric core portion and the TE-mode dielectric core portion are independently supported in the cavity, either the position of one of the dielectric core portions or the positions of both dielectric core portions can be fixed, and the TM-mode dielectric core portion and the TE-mode dielectric core portion are thereby arranged to have the asymmetry. According to this construction, the relative positional relationship between the TM-mode dielectric core portion and the TE-mode dielectric core portion and the positions thereof in the cavity can be determined after the apparatus is assembled. Alternatively, the intensity of coupling between the TM modes and the TE modes can be determined in a wide range at the time of assembly of the multimode dielectric resonator apparatus; and the coupling adjustment therefor can be implemented.

In other aspects of the invention, by coupling TM modes and TE modes according to other forms of asymmetry, indirect coupling can be easily implemented among a plurality of multimode resonators sequentially coupled to each other.

In further aspects of the invention, the TE-mode dielectric core portion is provided in a position deviating from the center of the plate-like portion, which is the TM-mode dielectric core portion, in the surface direction of the plate-like portion, thereby imparting the asymmetry thereto. According to this construction, TE modes in which electric-field vectors form an electric-field loop along the surface of the plate-like portion, which is the TM-mode dielectric core portion, are coupled to TM modes in which electric-field vectors extend perpendicular to the direction in which the TE-mode dielectric core portion is deviated.

According to a further aspect of the invention, in the multimode dielectric resonator apparatus, the dielectric core is provided in a position deviating from the center of the cavity in the surface direction of the plate-like portion, which is the TM-mode dielectric core portion, thereby imparting the asymmetry thereto. According to this construction, the electric-field vectors in TM modes in the TM-mode mode dielectric core portion are deformed, and perturbations are generated between the TM modes and TE modes forming a loop in the surface direction of the plate-like portion, thereby allowing the modes to be coupled together. Also, the position of the TE-mode dielectric core portion in the surface direction of the plate-like TM-mode dielectric core portion can be arranged asymmetrically. Therefore, manufacturing can be facilitated, and in addition, divergences in the electromagnetic fields of other resonant modes can be minimized.

According to another aspect of the present invention, a filter comprises the multimode dielectric resonator apparatus having the above-described construction, and input/output structures are coupled to predetermined resonant modes in the multimode dielectric resonator apparatus. According to this construction, the filter can be formed as a small, low-loss-type filter having multiple resonator stages provided by single dielectric core and a single cavity.

According to still another aspect of the invention, a filter comprises the above-described multimode dielectric resonator apparatus, either coaxial resonators or semicoaxial resonators that are coupled to predetermined modes, and input/output structures coupled to the aforementioned resonators. According to the abovedescribed construction, the semicoaxial resonators or the coaxial resonators are externally coupled, and secure coupling is thereby obtained by use of coupling loops to increase the band width. In addition, a spurious mode according to the aforementioned multimode dielectric resonator is minimized by use of either the semicoaxial resonators or the coaxial resonators, and the overall spurious-mode characteristics are thereby decreased. Furthermore, neither the semicoaxial resonators nor the coaxial resonators need to be securely coupled to the multimode dielectric resonator. Therefore, the input/output structures in the multimode dielectric resonator portion can be miniaturized, direct passage of signals between the input and the output can be reduced, and in addition, deterioration in characteristics due to such direct passage can thereby be prevented.

According to still another aspect of the invention, a duplexer comprises two of the aforementioned filters. According to this construction, the duplexer can be small as a whole and can be a low-loss type. The duplexer thus formed can be used as an antenna-sharing unit.

According to still another aspect of the invention, a communication apparatus either uses the aforementioned filter to permit transmission signals and reception signals to pass through a passband in a high-frequency circuit section, or uses the aforementioned duplexer as an antenna-sharing unit. According to this construction, the communication apparatus can be small overall and can be a low-loss type.

Other features and advantages of the present invention will become apparent from the following description of embodiments of the invention which refers to the accompanying drawings.

BRIEF DESCRIPTION OF THE DRAWINGS

FIGS. 4A and 4B show states of coupling between a TMx mode and a TEy mode;

FIG. 5 is a graph showing the relationship between the amount of deviation of a spherical portion forming a TE-mode dielectric core portion with respect to a plate-like portion and the coupling relationship between TM modes and TE modes;

DETAILED DESCRIPTION OF EMBODIMENTS OF THE INVENTION

Referring to FIGS. 1 to 6B, a description will be given of a configuration of a multimode dielectric resonator apparatus according to a first embodiment of the present invention.

Figure 1:
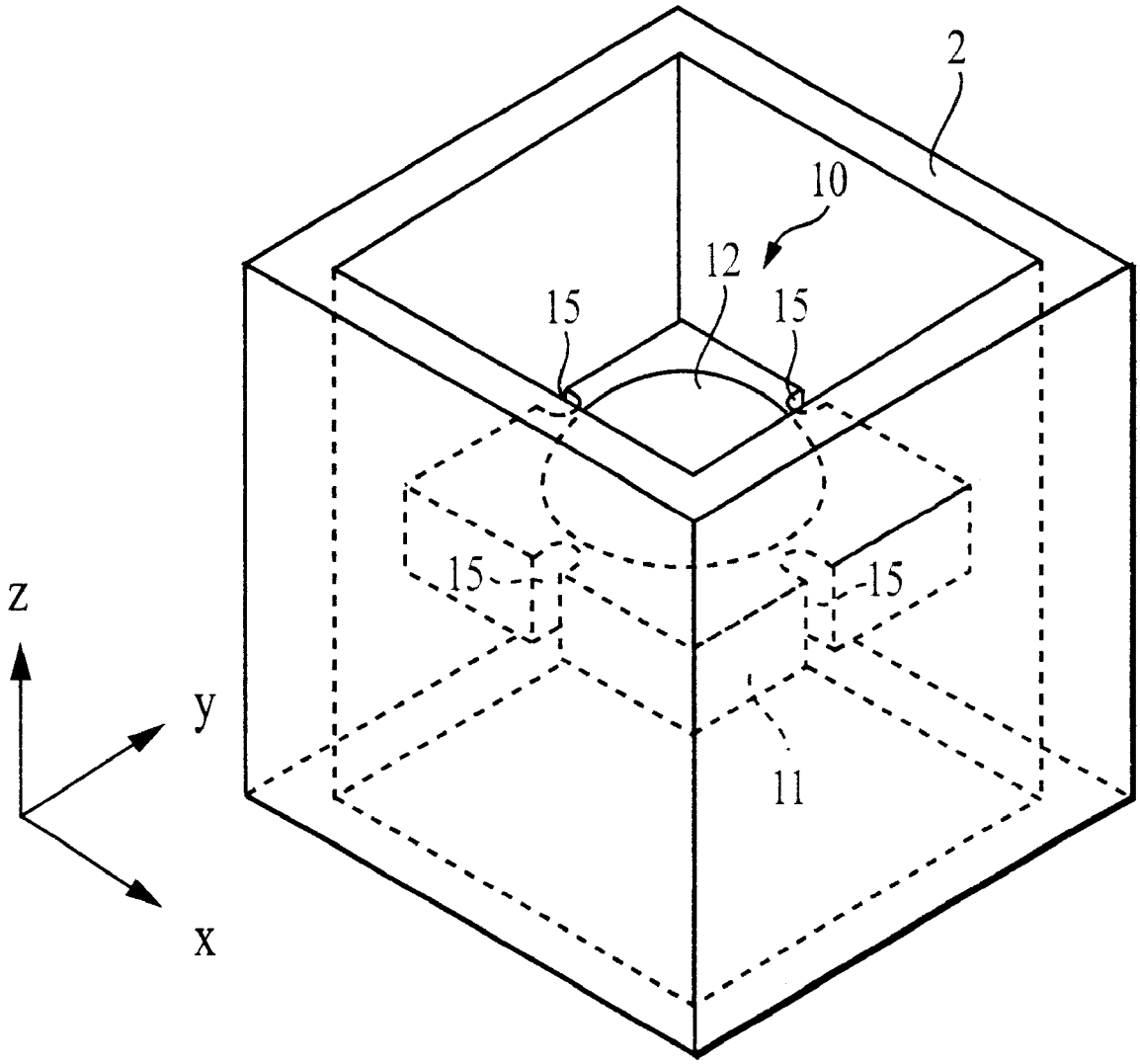
FIG. 1 is a perspective view showing a basic configuration of a multimode dielectric resonator apparatus according to a first embodiment.

FIG. 1 is a perspective view of a basic portion of the multimode dielectric resonator apparatus. Reference numeral 10 denotes a dielectric core, and 2 denotes a housing wall for housing the dielectric core 10. The housing wall 2 defines a cavity in which the dielectric core 10 is disposed and therefore will be referred to hereinafter for simplicity as a "cavity 2". The dielectric core 10 is formed of a plate-like TM-mode dielectric core portion 11 and a TE-mode dielectric core portion 12 spherically protruding from the TM-mode dielectric core portion 11. The cavity 2 is formed such that conductive films are formed on peripheral surfaces of a ceramic four-sided housing-like member. On upper and lower opening faces of the cavity 2 in the figure, are disposed either metal plates or dielectric plates on which conductive films are formed, and a substantially parallelepiped shield space is thereby formed. In FIG. 1, support members for supporting the dielectric core 10 in the cavity 2 and input/output connectors that perform input and output of signals to and from the outside have been omitted to clearly show the arrangement of the structure of the dielectric core 10 in the cavity.

Figure 2A:
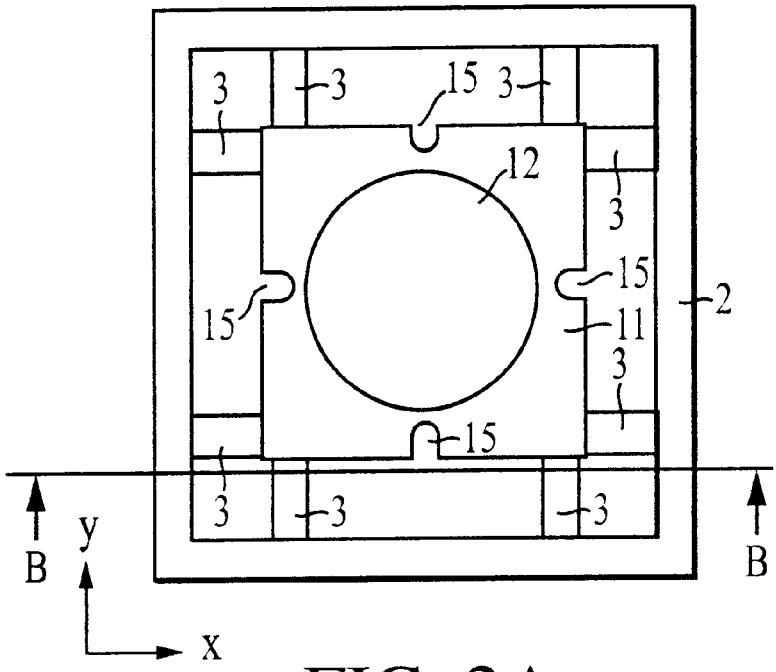
FIG. 2A is a top view of the multimode dielectric resonator apparatus in FIG. 1.
Figure 2B:
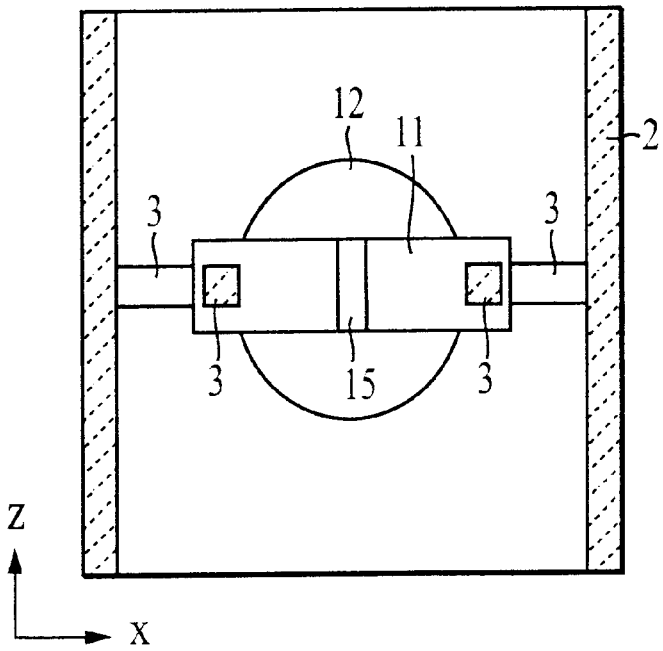
FIG. 2B is a cross-sectional view thereof.

FIG. 2A is a top view of the multimode dielectric resonator apparatus shown in FIG. 1, and FIG. 2B is a cross-sectional view of portion B—B in FIG. 2A. In FIGS. 2A and 2B, reference numeral 3 denotes individual support members for connecting the TM-mode dielectric core portion 11 of the dielectric core 10 to inner wall faces of the cavity 2. The support members 3 are made of a material having permittivity lower than that of the dielectric core 10. Grooves 15 are provided mainly for shifting a TEz-mode resonant frequency toward a higher frequency, as described below.

Figure 3A:
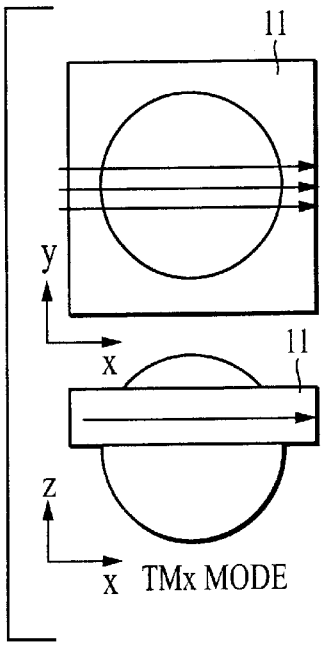
FIGS. 3A to 3E show electric-field distributions in individual modes.
Figure 3B:
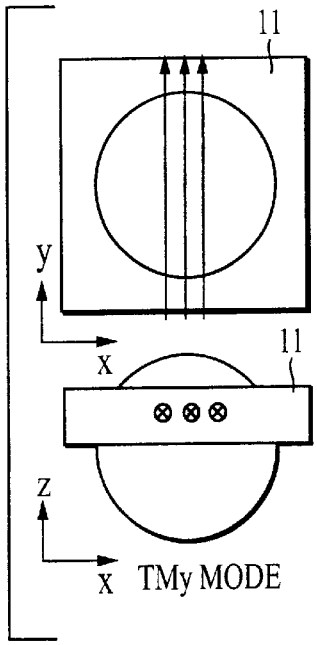
Figure 3C:
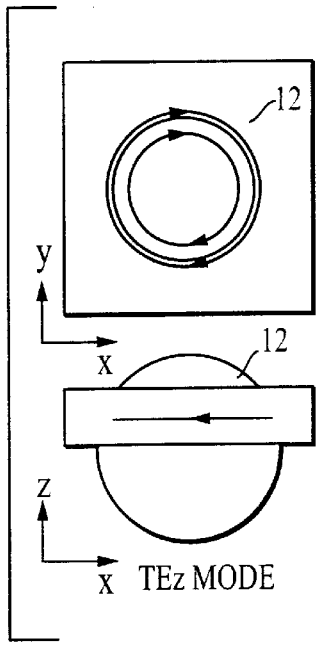
Figure 3D:
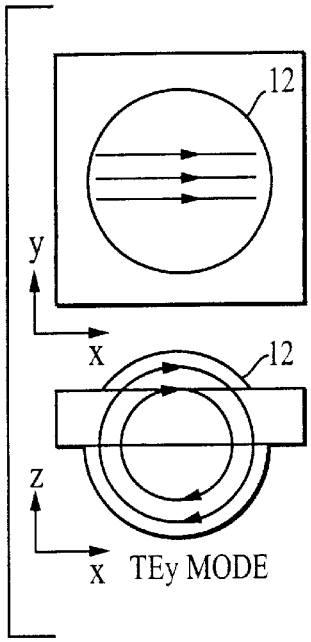
Figure 3E:
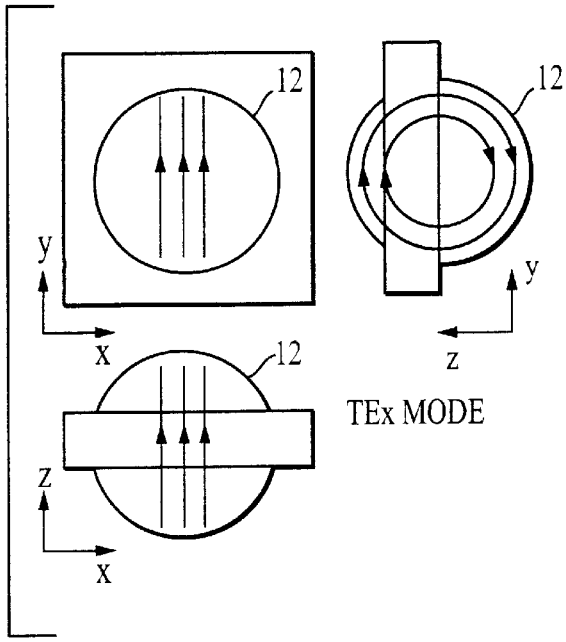

FIGS. 3A to 3E show five examples of resonant-mode electric field distributions that exist in the multimode dielectric resonator apparatus. FIG. 3A shows a TMx mode, and FIG. 3B shows a TMy mode. In the TMx mode, electric-field vectors extend from one of the conductive films formed on the peripheral surfaces of the cavity to the opposite one of the conductive films along the x-axis. Similarly, in the TMy mode, electric-field vectors extend along the y-axis. FIG. 3C shows a TEz mode, FIG. 3D shows a TEy mode, and FIG. 3E shows a TEx mode. In the TEz mode, electric-field vectors form loops in the plane direction perpendicular to the z-axis; in the TEy mode, electric-field vectors form loops in the plane direction perpendicular to the y-axis; and in the TEx mode, electric-field vectors form a loop in the plane direction perpendicular to the x-axis.

A TMz mode in which electric-field vectors extend along the z-axis is also generated. However, since the dimension in the thickness direction of the plate-like TM-mode dielectric core portion 11 is smaller than the dimensions in the other directions, the resonant frequency of the TMz mode is higher than the resonant frequencies of the other modes, i.e., higher than the operating frequency band.

FIGS. 4A and 4B show states of coupling the above-described TMx mode and TEy mode. Arrows indicated in the figure with curved lines represent electric-field vectors. The mode shown in FIG. 4A is assumed to be an even mode, and the mode shown in FIG. 4B is assumed to be an odd mode. Since the protruding amount of the spherical TE-mode dielectric core portion 12 with respect to the plate-like TM-mode dielectric core portion 11 is asymmetric, perturbations are applied to electric-field intensity distributions in the TMx mode and the TEy mode. Accordingly, energy is transferred between the TMx mode and the TEy mode, and the two modes are coupled together.

Examples in FIGS. 4A and 4B are views showing a cross section in the x-z plane extending through the center of the dielectric core 10. However, the electric-field vectors in the TMy mode and the TEx mode form similar patterns also on a cross section in the y-z plane extending through the center of the dielectric core 10. This allows the TMy mode and the TEx mode to be similarly coupled together.

FIG. 5 shows the relationship between the amount of deviation in the z-axis direction of the spherical portion, which is the TE-mode dielectric core portion 12, with respect to the plate-like portion, which is the TM-mode dielectric core portion 11, and the coefficient of coupling between the aforementioned TM and TE modes. The coupling coefficient between the two modes increases in proportion to the aforementioned deviation amount. Using this relationship, the aforementioned deviation amount is determined so as to meet a predetermined coupling coefficient.

Figure 6A:
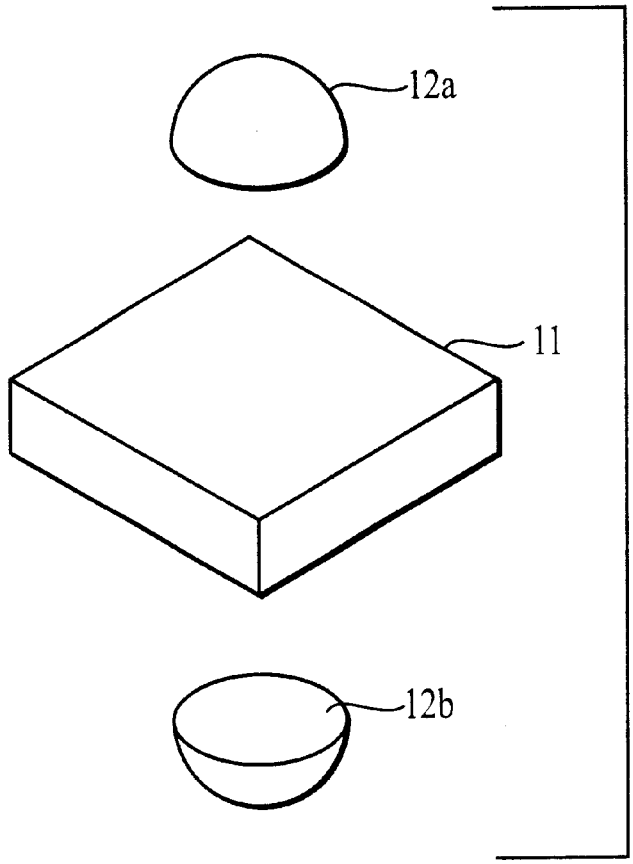
FIGS. 6A and 6B show the relationship between a TM-mode dielectric core portion and a TE-mode dielectric core portion.
Figure 6B:
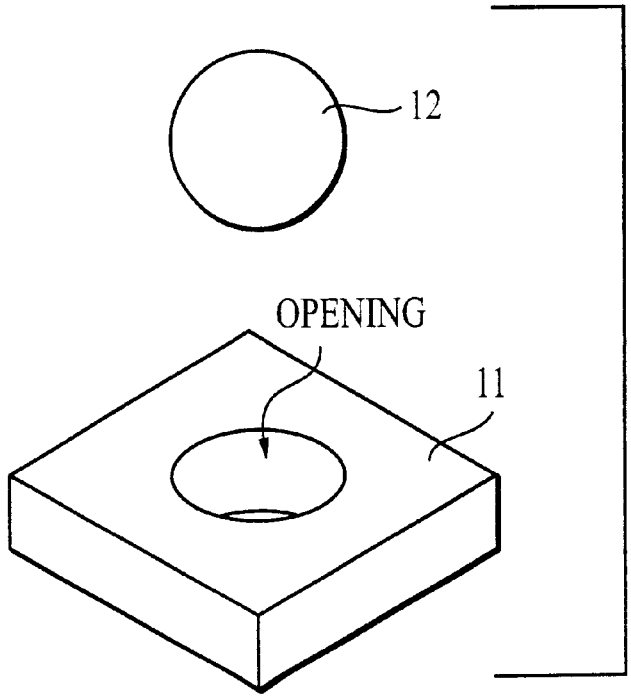

The electromagnetic fields in the described individual modes of the TM mode and the TE mode coexist in a central portion of the dielectric core 10, comprising the TM-mode dielectric core portion 11, and the TE-mode dielectric core portion 12. As shown in FIG. 6A, these two portions can be separated into a plate-like TM-mode dielectric core portion 11 and two hemispherical TE-mode dielectric core portions 12a and 12b. Alternatively, as shown in FIG. 6B, they can be separated into a platelike TM-mode dielectric core portion 11 having an opening in the central portion and a spherical TE-mode dielectric core portion 12 to be inserted therein. In the case shown in FIG. 6A, TM-mode electric-field vectors extend to the TM-mode dielectric core portion 11. In the case shown in FIG. 6B, TE-mode electric-field vectors extend to the TE-mode dielectric core portion 12. It is to be noted that parts of the TM-mode dielectric core portion 11 and the TE-mode dielectric core portion 12 in the central portion of the dielectric core are shared by the TM modes and the TE modes.

Hereinbelow, referring to FIGS. 7A to 12B, a description will be given of configurations of multimode dielectric resonator apparatuses using other dielectric cores having different shapes. In the individual figures, the figures having the reference symbol "A" attached thereto are top views, and figures having the reference symbol "B" attached thereto are cross-sectional views thereof.

Figure 7A:
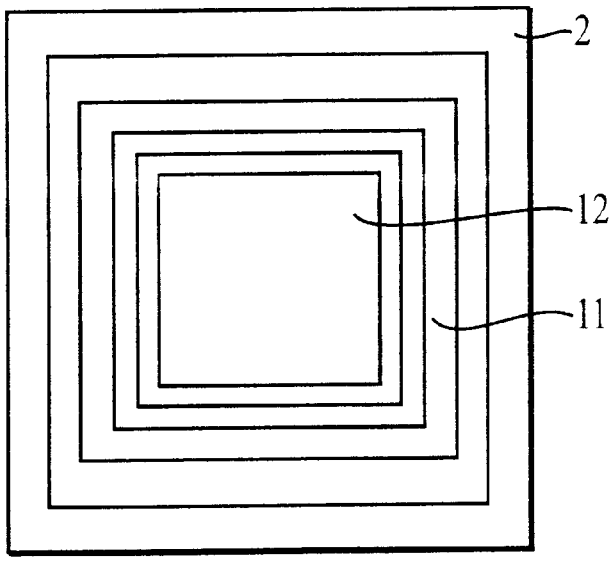
FIGS. 7A and 7B show an example of a shape of the TE-mode dielectric core portion.
Figure 7B:
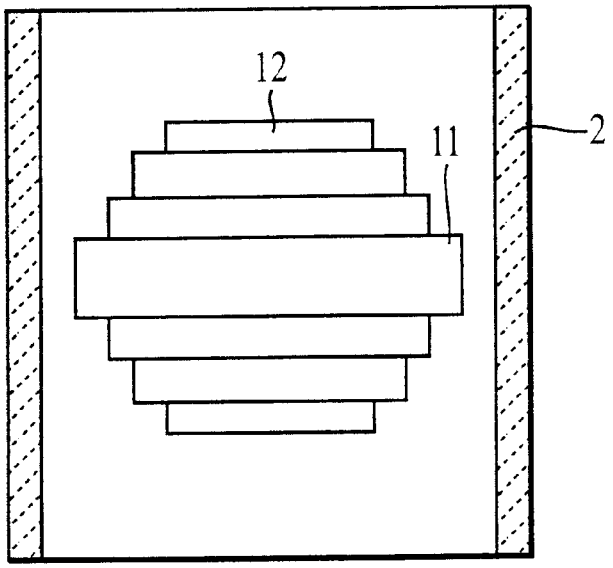
Figure 8A:
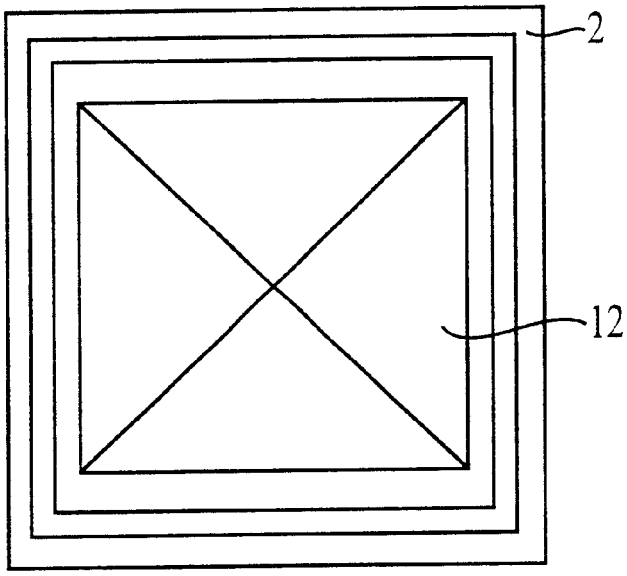
FIGS. 8A and 8B show another example of a shape of the TE-mode dielectric core portion.
Figure 8B:
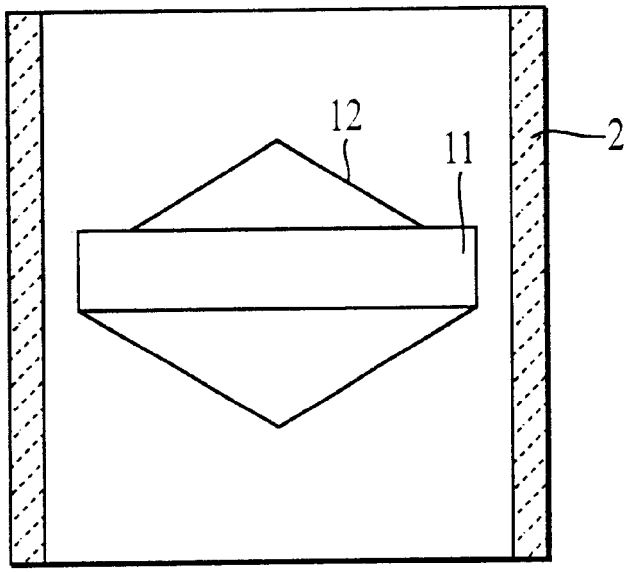
Figure 9A:
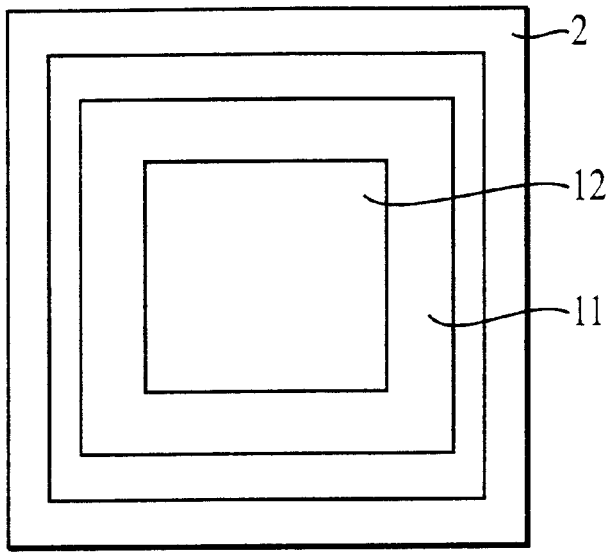
FIGS. 9A and 9B show still another example of a shape of the TE-mode dielectric core portion.
Figure 9B:
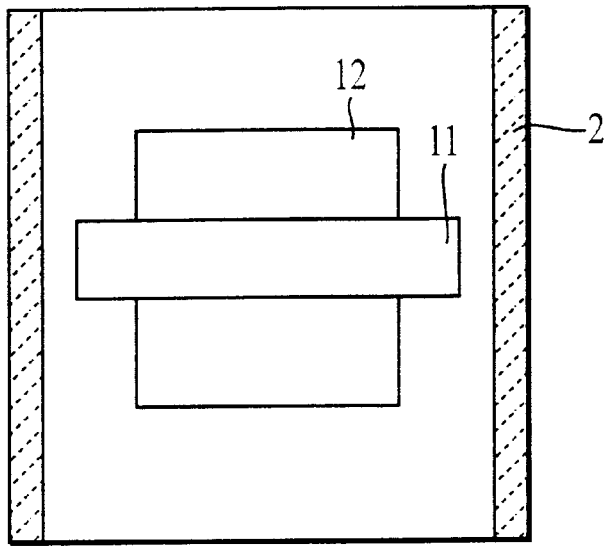
Figure 10A:
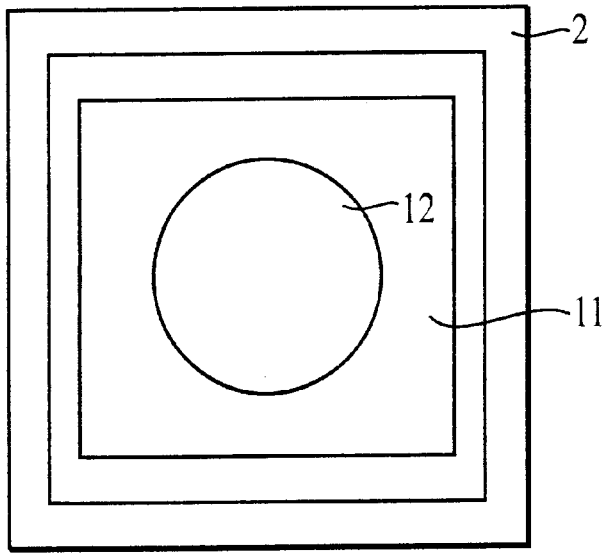
FIGS. 10A and 10B show still another example of a shape of the TE-mode dielectric core portion.
Figure 10B:
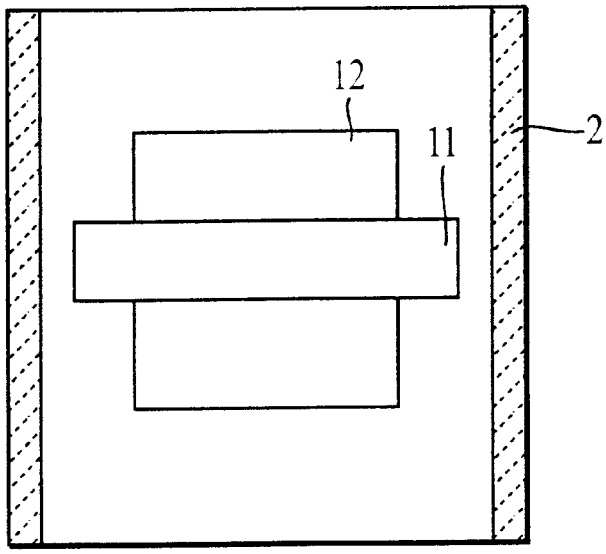
Figure 11A:
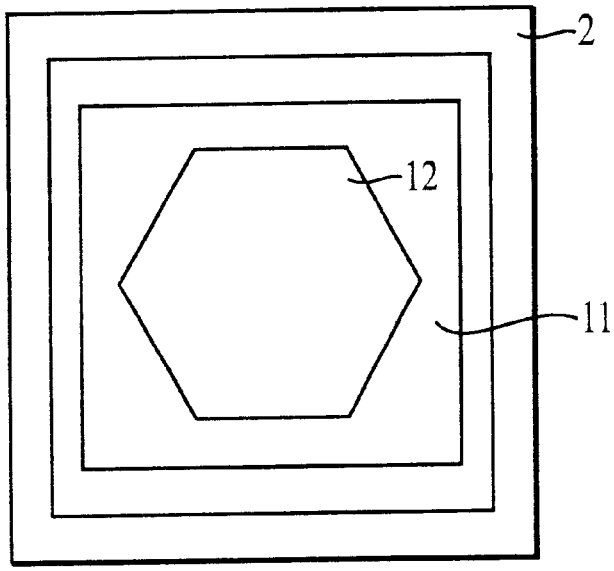
FIGS. 11A and 11B show still another example of a shape of the TE-mode dielectric core portion.
Figure 11B:
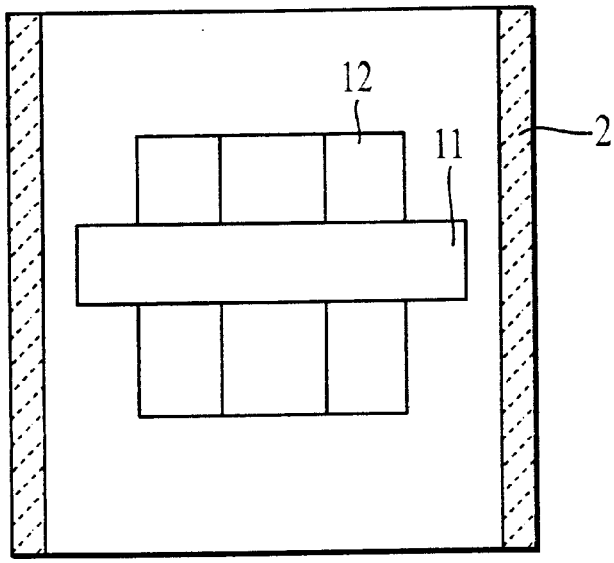
Figure 12A:
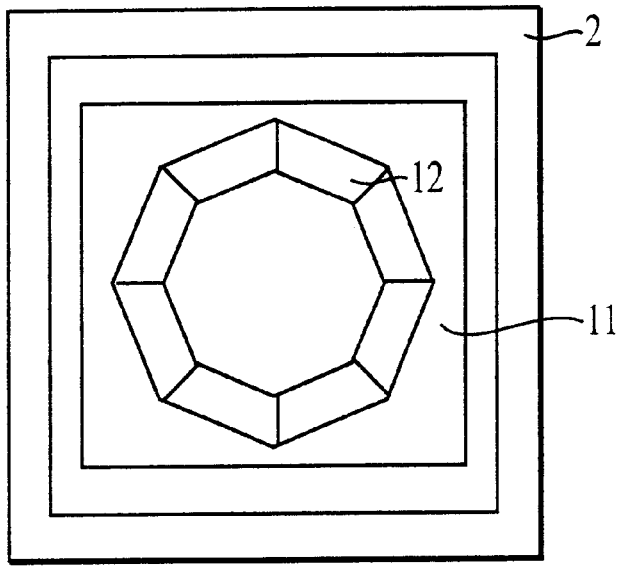
FIGS. 12A and 12B show still another example of a shape of the TE-mode dielectric core portion.
Figure 12B:
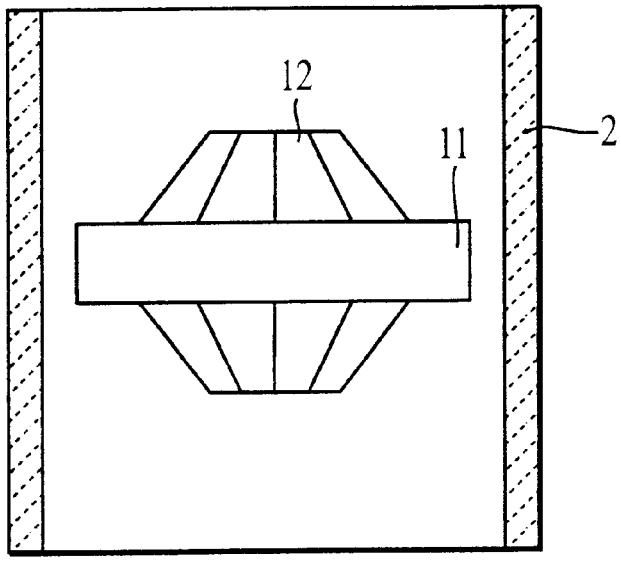

In an example shown in FIGS. 7A and 7B, a TE-mode dielectric core portion 12 is provided in the shape of a stepped pyramid. That is, a four-sided pyramid-like base with steps is formed projecting upward and downward from the TM-mode dielectric core portion 11. In an example shown in FIGS. 8A and 8B, a TE-mode dielectric core portion 12 has the shape of a four-sided pyramid protruding upward and downward from the TM-mode dielectric core portion 11. In an example shown in FIGS. 9A and 9B, a TE-mode dielectric core portion 12 having the shape of a four-sided column protrudes upward and downward from the TM-mode dielectric core portion 11. In an example shown in FIGS. 10A and 10B, a TE-mode dielectric core portion 12 having the shape of a circular column protrudes upward and downward from the TM-mode dielectric core portion 11. In an example shown in FIGS. 11A and 11B, a TE-mode dielectric core portion 12 having the shape of a hexagonal column is formed to protrude up and down from the TM-mode dielectric core portion 11. In an example shown in FIGS. 12A and 12B, a TE-mode dielectric core portion 12 having the shape of an octagonal column is formed to protrude inward and downward from the TM-mode dielectric core portion 11. Alternatively, the TE-mode dielectric core portion may be a polyhedral protruding portion having such shapes as a polyhedral column, a polyhedral pyramid, and a polyhedral trapezoid, for example.

With any one of these shapes, the plate-like TM-mode dielectric core portion 11 and the cavity 2 mainly function as a resonator in the TMx mode and the TMy mode; and the TE-mode dielectric core portion 12 mainly functions as a resonator in the TEx mode, TEy mode, and TEz modes. Also, the protruding amounts of the upper and lower portions of the TE-mode dielectric core portion 12 with respect to the TM-mode dielectric core portion 11 are arranged to be asymmetric. Thereby, coupling between the TMx mode and the TEy mode can be obtained concurrently with coupling between the TMy mode and the TEx mode.

Figure 13A:
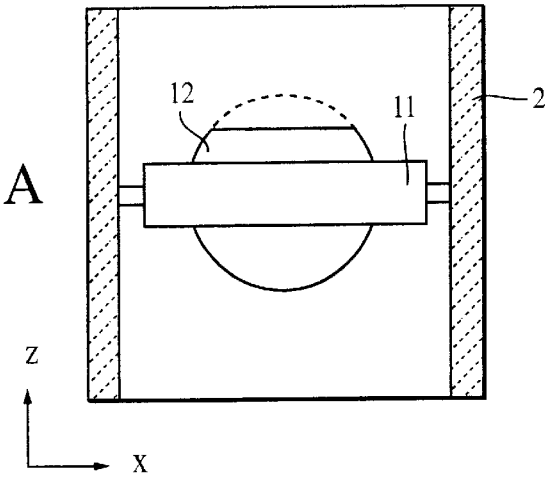
FIGS. 13A and 13B show still other examples of shapes of the TE-mode dielectric core portion.
Figure 13B:
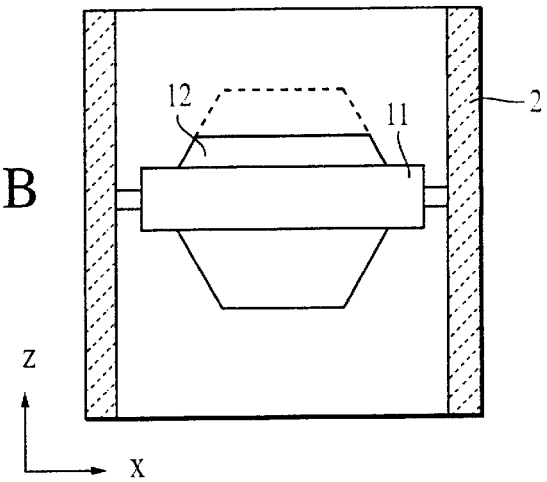

FIGS. 13A and 13B are cross-sectional views of two dielectric cores differing in shape from each other. In the examples described above, predetermined types of dielectric cores 10 are formed by first determining the shapes of the upper and lower portions of the TE-mode dielectric core portion 12 and then setting the respective protruding amounts of the upper and lower portions with respect to the TM-mode dielectric core portion 11. Alternatively, however, as shown in FIGS. 13A and 13B, the shape of the TE-mode dielectric core portion 12 may be formed by providing a TE-mode dielectric core portion 12 which is originally symmetric with respect to the TM-mode dielectric core portion 11, and then removing part of the TE-mode dielectric core portion 12, and asymmetry is thereby provided.

Figure 14:
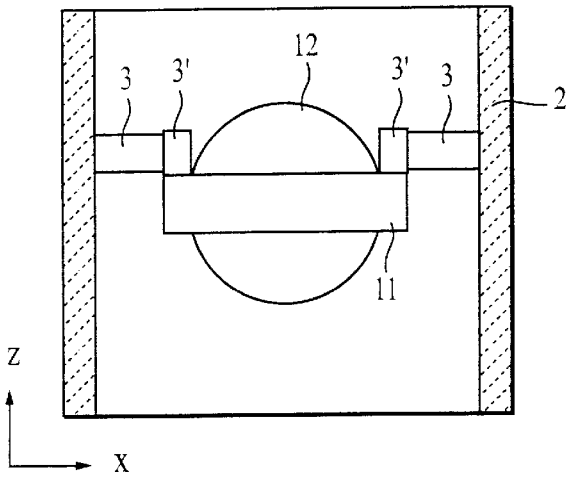
FIG. 14 shows an example of a support structure for a dielectric core in a cavity.

FIG. 14 is a cross-sectional view of another dielectric core. In this example, support members 3' are fitted to a TM-mode dielectric core portion 11, and other support members 3 are used to support the portions between the cavity 2 and the support members 3'. According to this construction, the symmetry of the dielectric members existing on the upper and lower portions of the TM-mode dielectric core portion 11 is deformed, so that electric field vectors of the individual resonant modes are concentrated on the side where the greater number of dielectric members exist. This provides the asymmetry. Thereby, coupling is generated between the TMx mode and the TEy mode and between the TMy mode and the TEx mode. In this arrangement, the coupling amounts are determined according to the relative permittivities and the arrangement positions of the support members 3 and 3'.

Hereinbelow, referring to FIGS. 15A and 15B, a description will be given of an example of a filter in which the above-described five resonant modes are sequentially coupled to each other.

Figure 15A:
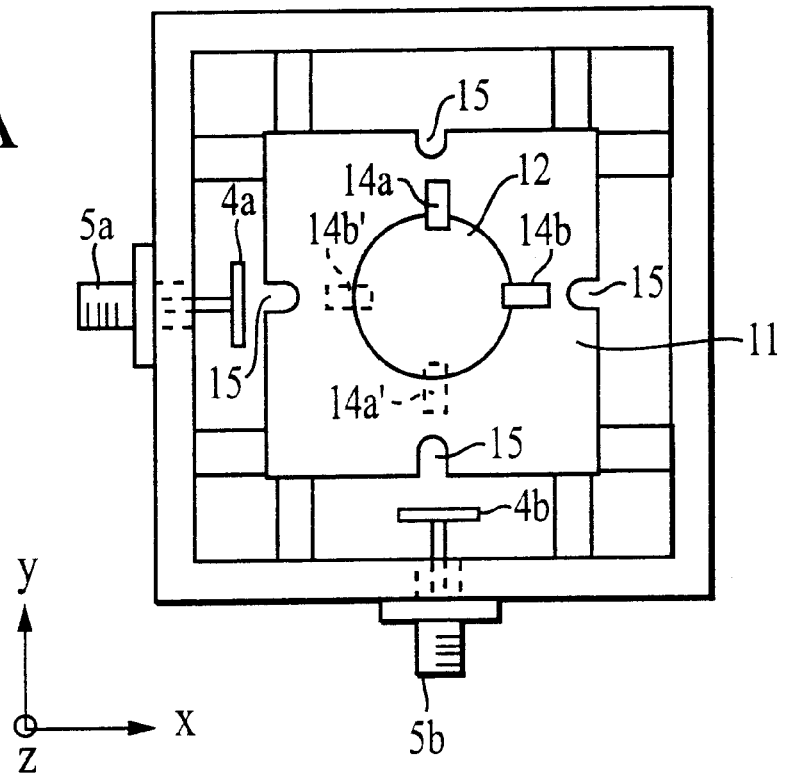
FIGS. 15A and 15B show an example of a filter using a quintuple mode resonator configured of the individual modes sequentially coupled to each other.
Figure 15B:
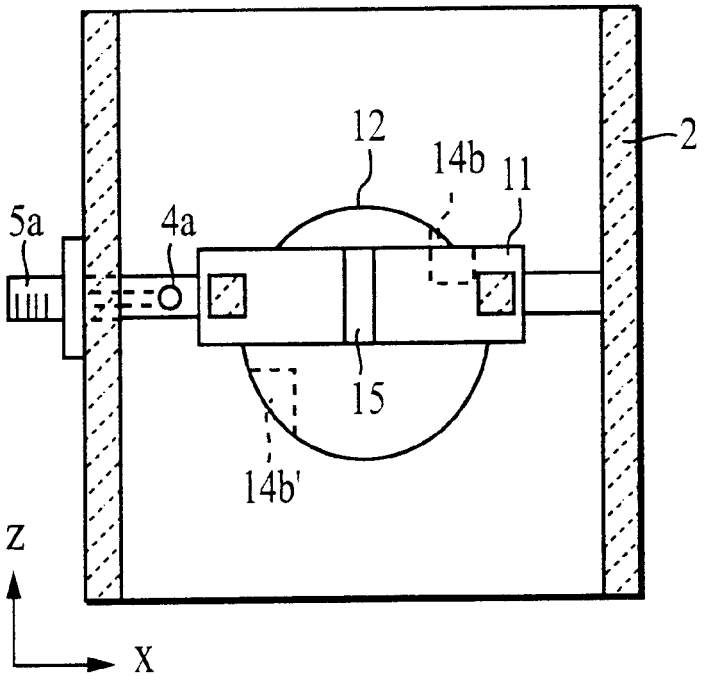

FIG. 15A is a top view, and FIG. 15B is a cross-sectional view thereof. In these figures, reference symbols 5*a* and 5*b* each denotes a coaxial connector, and probes 4*a* and 4*b* each jutting out into a cavity 2 are fitted to the central conductors thereof. Reference symbols 14*a* and 14*a*' denote grooves for coupling the TEy mode and the TEz mode together, and in addition, reference symbols 14*b* and 14*b*' denote coupling grooves for coupling the TEx mode and the TEz mode together.

Figure 16A:
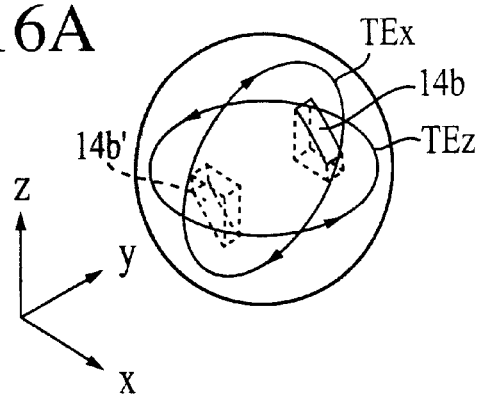
FIGS. 16A to 16D show states of coupling between TEx modes and TEz modes.
Figure 16B:
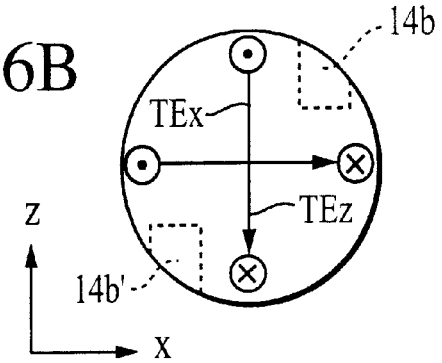
Figure 16C:
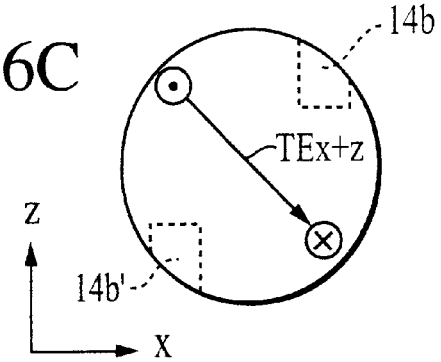
Figure 16D:
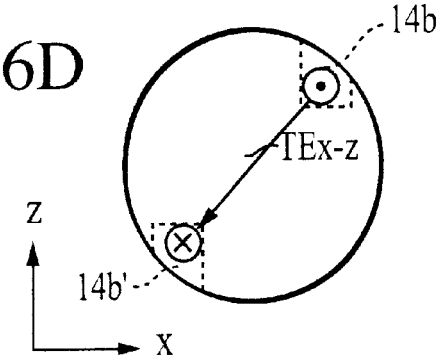

FIGS. 16A to 16D show a mode of operation of the above-described coupling grooves 14*b* and 14*b*'. FIG. 16A is a perspective view of electric-field vectors in the TEx mode and the TEz mode, and FIG. 16B shows electric-field vectors in the two modes in an x-z plane cross section. In this case, when a sum mode of the TEx mode and the TEz mode (TEx+z mode) is considered, the mode forms a loop in a plane perpendicular to the x+z axis direction, as shown in FIG. 16C. Also, as shown in FIG. 16D, a vector in a difference mode between the TEx mode and the TEz mode (TEx−z mode) becomes a mode that forms a loop in a plane perpendicular to the x−z axis direction.

Since the coupling grooves 14*b* and 14*b*' exist in a position where the electric-field vector in the TEx−z mode passes through, they function in the direction of weakening the electric field in the TEx−z mode, and the TEx mode and the TEz mode are coupled together according to the perturbations. Similarly, in FIGS. 15A and 15B, the coupling grooves 14 and 14' provide perturbations to a TEy+z mode and a TEy−z mode, and thereby allow the TEy mode and the TEz mode to be coupled together.

Thus, since TMx-mode→TEy-mode coupling and TEx-mode→TMy-mode coupling are generated by the vertical asymmetry of a TM-mode dielectric core and a TE-mode dielectric core, TEx-mode→TEz-mode coupling is generated by the coupling groove 14*a*, and TEz-mode→TEx-mode coupling is generated by the coupling groove 14*b*, the configuration functions as a quintuple-mode resonator in which five resonators are coupled to each other in the order of TMx→TEy→TEz→TEx→TMy.

In FIGS. 15A and 15B, the probe 4*a* couples by electric fields to the TMx mode, which is a first-stage resonator; and the probe 4*b* couples by electric fields to a TMy mode, which is a last-stage resonator. Therefore, the portion between the coaxial connectors 5*a* and 5*b* forms a filter presenting characteristics of a band-pass filter using five stages of resonators.

Hereinbelow, referring to FIGS. 17A to 20B, a description will be given of examples of filters in which so-called indirect coupling is provided.

FIGS. 17A to 17D are top views of filters with an upper cover of a cavity removed. In the example shown in FIG. 17A, the center of a TM-mode dielectric core portion 11 is provided in the center of a TE-mode dielectric core portion 12, and the center of the TE-mode dielectric core portion 12 is shifted from the center of the TM-mode dielectric core portion 11 in the y-axis direction.

Figure 17A:
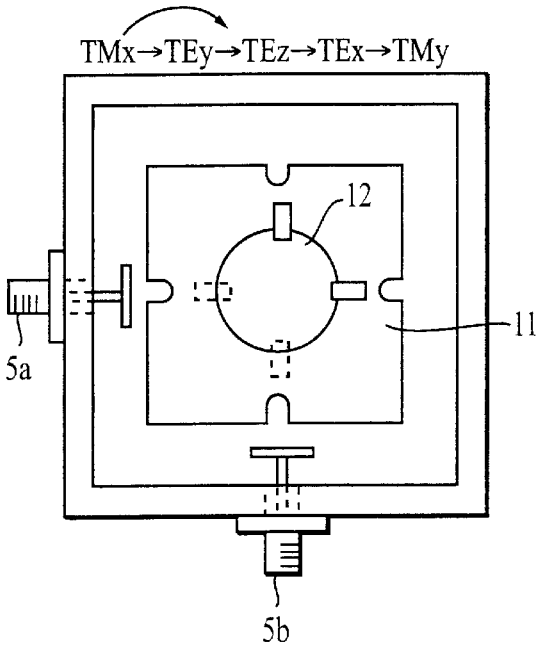
FIGS. 17A to 17D show examples of filters using other quintuple mode resonators.
Figure 18A:
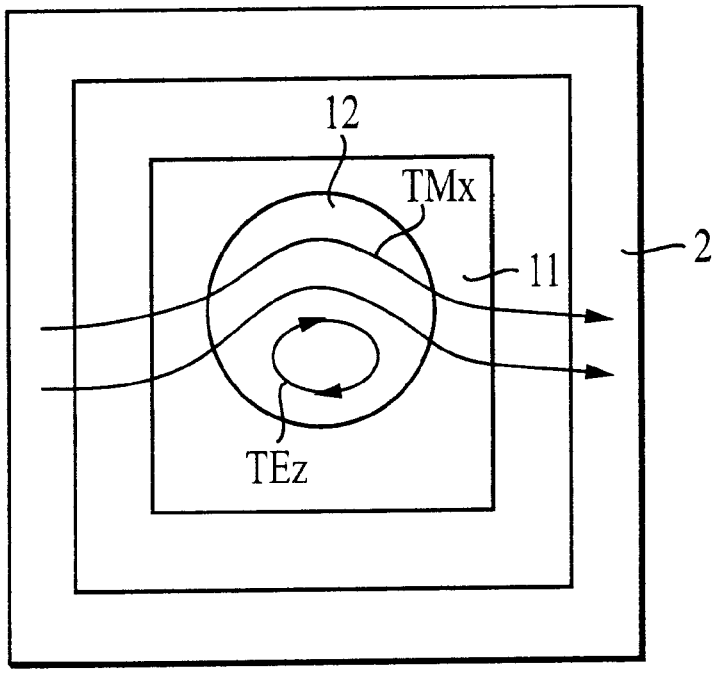
FIGS. 18A and 18B show states of coupling between a TEz mode and a TMx mode.
Figure 18B:
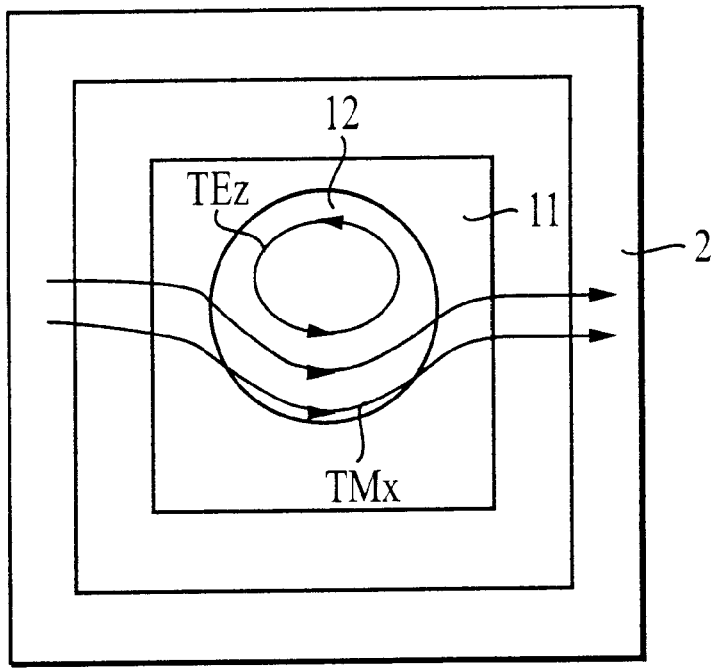

FIGS. 18A and 18B each show a state of a TMx mode and a TEz mode in the filter shown in FIG. 17A. Thus, by making the TM-mode dielectric core portion 11 and the TE-mode dielectric core portion 12 asymmetric to each other, perturbations are generated in the electric-field distributions of the TMx mode and the TEz mode, and the two modes are thereby coupled together. Since the two modes are first and third resonator stages, they are indirectly coupled together.

Figure 17B:
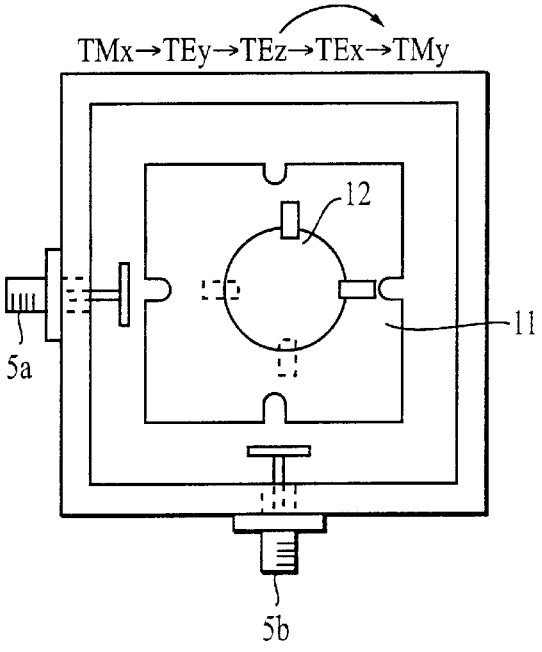

Similarly, as shown in FIG. 17B, by shifting the TE-mode dielectric core portion 12 in the x-axis direction, perturbations are generated in the electric-field distributions of the TMy mode and the TEz mode, and the two modes are thereby coupled together. Since these two modes are third and fifth resonator stages they are indirectly coupled together.

Figure 17C:
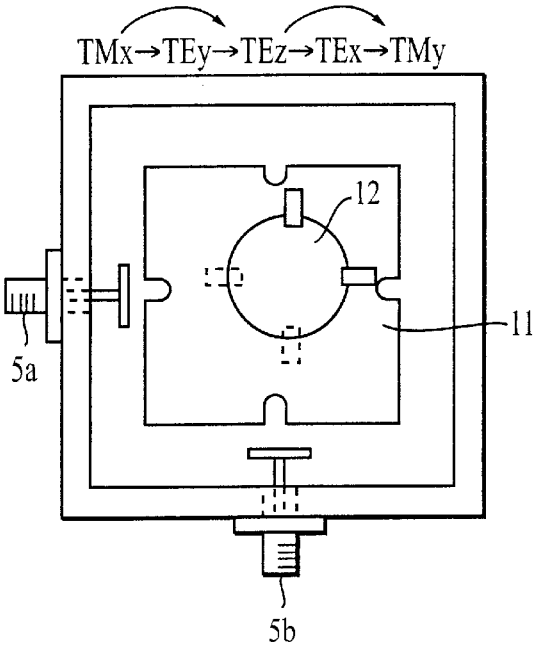

Also, as shown in FIG. 17C, by shifting the TE-mode dielectric core portion 12 in both the x-axis direction and the y-axis direction, the TMx mode and the TEz mode are indirectly coupled together, and concurrently, the TMy mode and the TEz mode are indirectly coupled together. That is, the first stage and the third stage are indirectly coupled together, and in addition, the third stage and the fifth stage are indirectly coupled together.

Figure 17D:
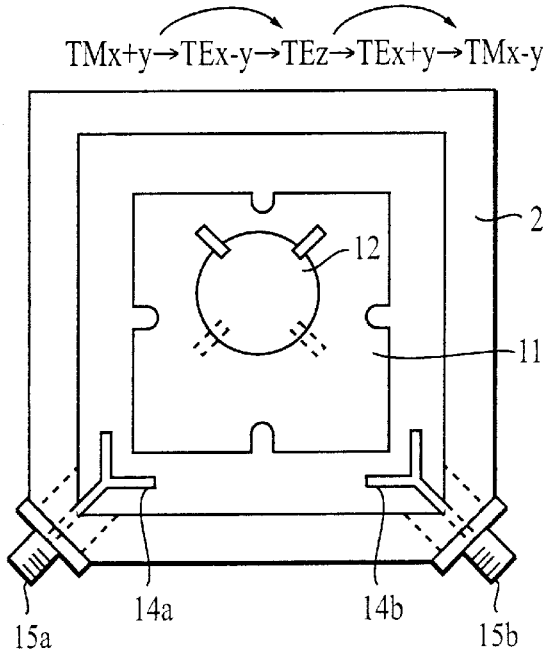

In the example shown in FIG. 17D, a probe 14*a* connected to a central conductor of a coaxial connector 15*a* is arranged in an x+y axis direction and is provided in a corner portion of a TM-mode dielectric core portion 11. A probe 14*b* connected to a central conductor of a coaxial connector 15*b* is arranged in an x−y axis direction and is provided in another corner portion of the TM-mode dielectric core portion 11. Therefore, the probe 14*a* couples to a TMx+y mode, and the probe 14*b* couples to a TMx−y mode. Thus, quintuple resonant modes according to the TM-mode dielectric core portion 11 are coupled to each other in the order of TMx+y→TEx−y→TEz→TEx+y→TMx−y. In this example, since a TE-mode dielectric core portion 12 is shifted from the center of a dielectric core in the y-axis direction, perturbations are generated in the individual electric-field distributions of the TMx+y mode and the TEz mode, and these two modes are thereby coupled together. Similarly, perturbations are generated in the individual electric-field distributions of the TMx−y mode and the TEz mode, and these two modes are thereby coupled together. Therefore, a first stage and a third stage are indirectly coupled together, and the third stage and a fifth stage are indirectly coupled together.

FIGS. 19A to 19D show examples in each of which predetermined TM modes and predetermined TE modes are coupled so as to cause indirect coupling therebetween. In the examples shown therein, the entity of a dielectric core 10 is arranged in a position shifted from the center of a cavity 2 in the y-axis direction.

Figure 19A:
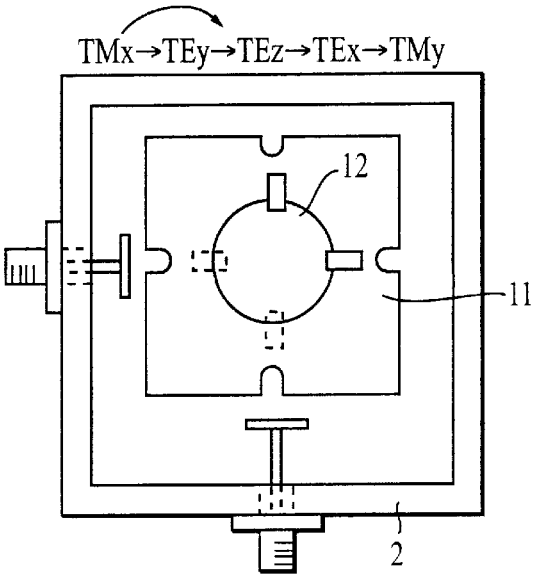
FIGS. 19A to 19D show examples of filters using other quintuple mode resonators.
Figure 19B:
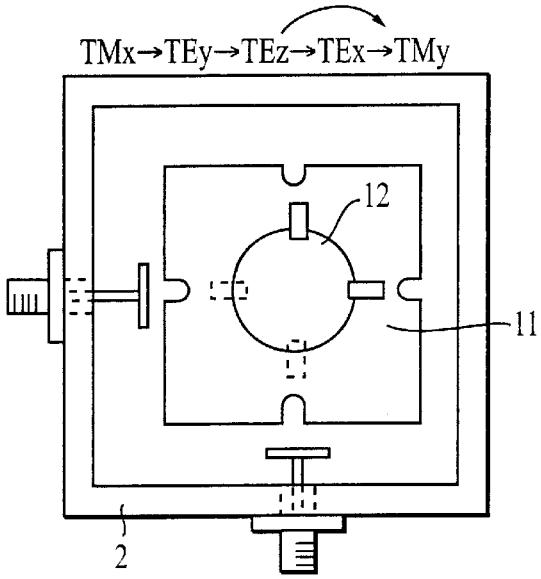
Figure 19C:
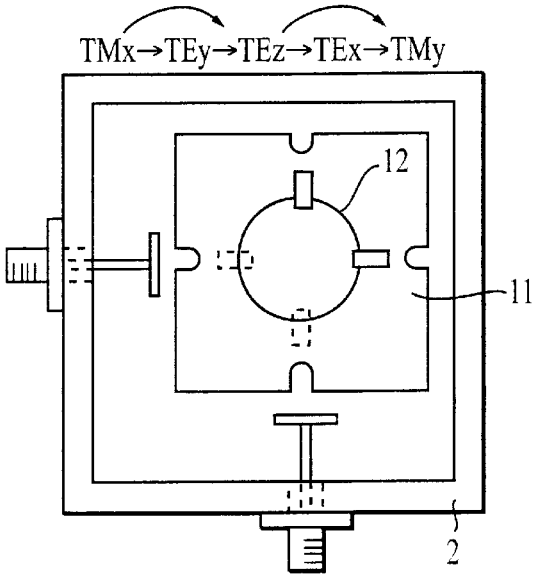
Figure 20A:
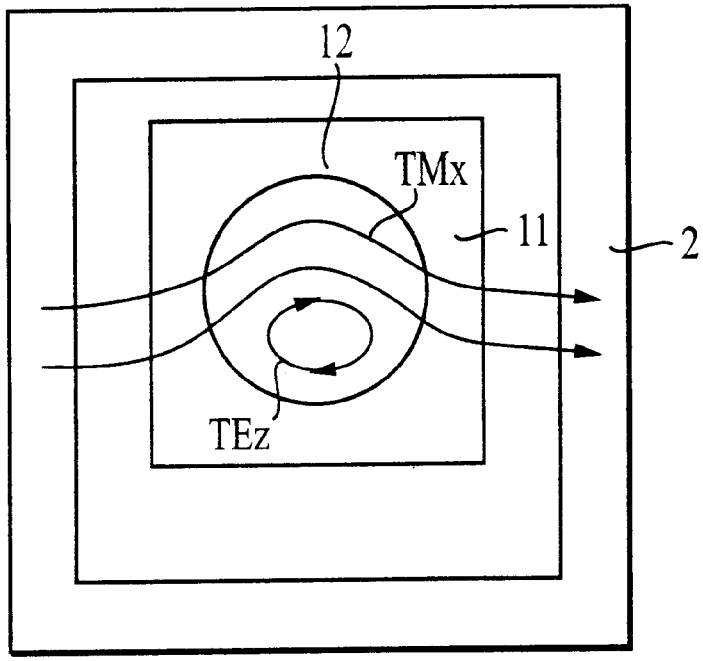
FIGS. 20A and 20B show states of coupling between a TEz mode and a TMx mode.
Figure 20B:
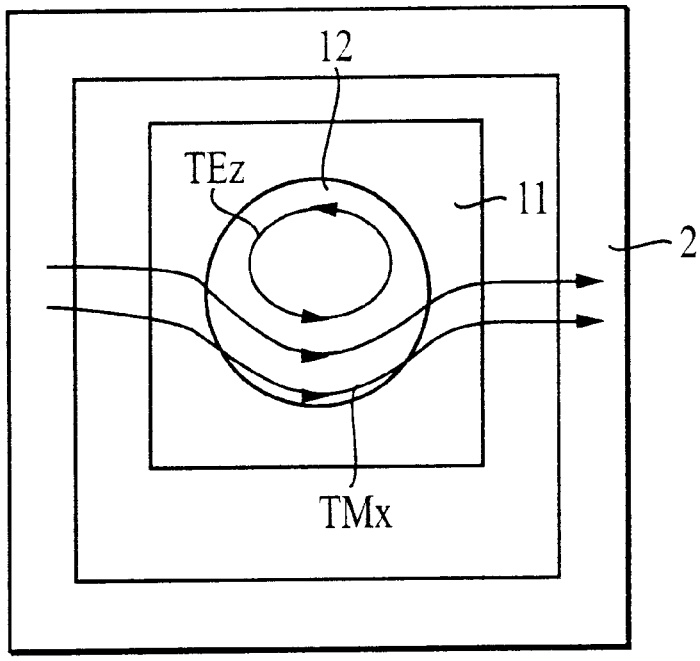

FIGS. 20A and 20B each show a state of a TMx mode and a TEz mode in the filter shown in FIG. 19A. Thus, depending on the position of the dielectric core in the cavity 2, the electric-field vectors in the TMx mode are attracted toward the wallface side of the cavity 2. Therefore, perturbations are generated into the TMx mode and the TEz mode, the TMx mode and the TEz mode are coupled together; that is, the first stage and the third stage are indirectly coupled together. Similarly, as shown in FIG. 19B, by shifting a dielectric core 10 in the x-axis direction, the TMy mode and the TEz mode are coupled together; that is, a third stage and a fifth stage are indirectly coupled together. Also, as shown in FIG. 19C, by shifting a dielectric core 10 in both the x-axis direction and the y-axis direction, the TMx mode and the TEz mode are coupled together, and the TEz mode and the TMy mode are coupled together; that is, a third stage and a fifth stage are indirectly coupled together, and the third stage and a fifth stage are indirectly coupled together.

Figure 19D:
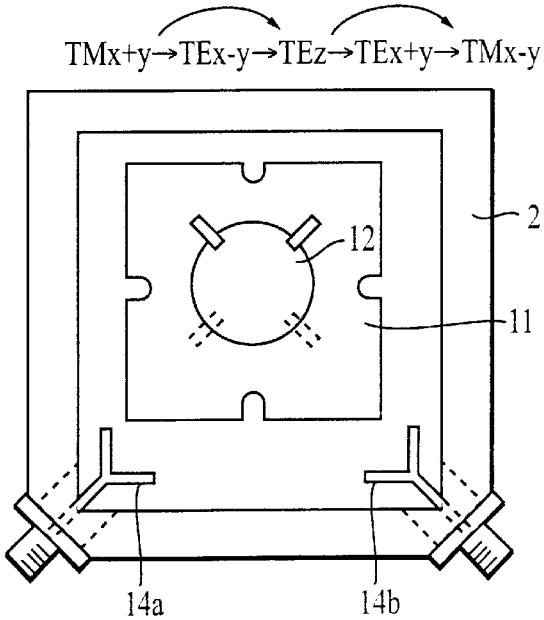

In addition, in the example shown in FIG. 19D, a probe 14*a* couples to a TMx+y mode, and a probe 14*b* couples to a TMx−y mode; thus, quintuple resonant modes are coupled to each other in the order of TMx+y→TEx−y→TEz→TEx+y→TMx−y. In this example, a dielectric core 10 is shifted from the center of a cavity 2 in the y-axis direction. Therefore, perturbations are generated in the individual electric-field distributions of the TMx+y mode and the TEz mode, and these two modes are thereby coupled together. Similarly, perturbations are generated in the individual electric-field distributions of the TMx−y mode and the TEz mode, and these two modes are thereby coupled together. That is, a first stage and a third stage are indirectly coupled together, and the third stage and a fifth stage are indirectly coupled together.

In the above-described manners, indirect coupling is caused in either one portion or two portions, and either one attenuation pole or two attenuation poles are generated depending on the indirect coupling. For example, an attenuation pole is generated either in the low-band side of a passband or in the high-band side thereof; alternatively, the attenuation pole is generated in both of the two sides, thereby sharpening the bandpass characteristics in the transition from the passband to the attenuation bands.

Hereinbelow, referring to FIGS. 21A and 21B, a description will be given of a multimode dielectric resonator apparatus that uses a dielectric core having a construction that differs from those described above.

Figure 21A:
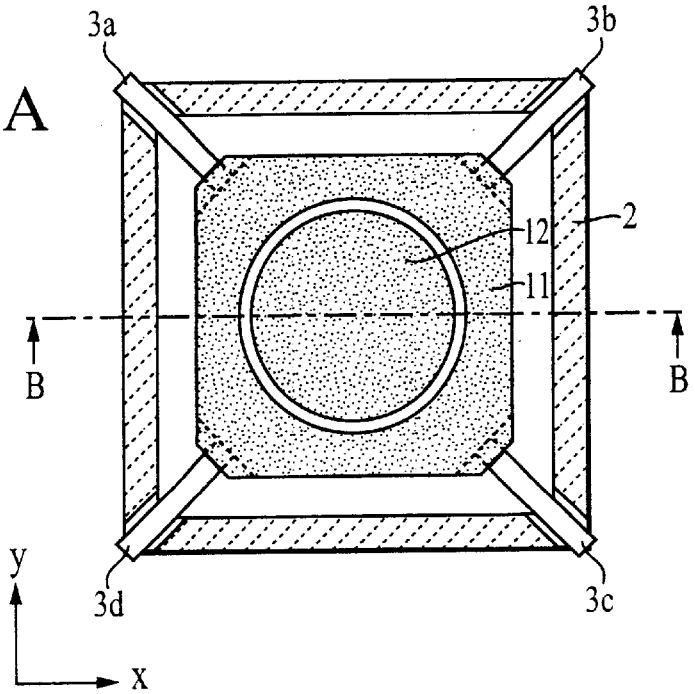
FIGS. 21A and 21B show other examples of support structures for a dielectric core in a cavity.
Figure 21B:
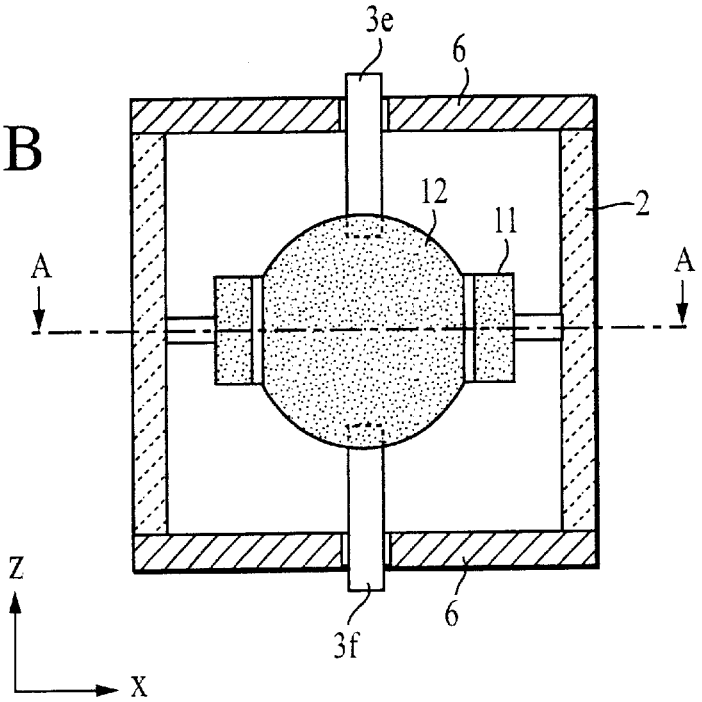

FIG. 21A is a cross sectional view taken in a horizontal plane at an intermediate height of the multimode dielectric resonator apparatus, and FIG. 21B is a cross-sectional view taken in a vertical plane extending through the center. Specifically, FIG. 21A is a cross-sectional view along the line A—A, and FIG. 21B is a cross-sectional view along the line B—B.

In FIGS. 21A and 21B, reference numeral 11 denotes a TM-mode dielectric core portion having a dielectric-plate-like shape in which a central circular portion is cut out, and reference numeral 12 denotes a spherical TE-mode dielectric core portion to be inserted in the aforementioned opening. The TM-mode dielectric core portion 11 is supported in a cavity 2 such that four corners thereof are supported by support members 3*a* to 3*d*. The TE-mode dielectric core portion 12 is supported such that upper and lower portions thereof are supported by support members 3*e* and 3*f* to cover portions 6 that cover upper and lower opening faces of the cavity 2. All the support members 3*a* to 3*f* are formed of a low-permittivity material. Before the dielectric core portions 11 and 12 are immobilized, the individual support members 3*a* to 3*f* are provided so as to be movable with respect to the cavity 2 and cover portions 6. Therefore, the TM-mode dielectric core portion 11 is movable by a specific amount in the xy-plane direction. Thus, by immobilizing the support members 3*a* to 3*d* at predetermined positions of wall faces of the cavity 2, the position of the TM-mode dielectric core portion 11 in the cavity 2 can be determined. Similarly, before the support members 3*e* and 3*f* are immobilized to the cover portions 6, the TE-mode dielectric core portion 12 is movable in the z-axis direction. Thus, by immobilizing the support members 3*e* and 3*f* to the cover portions 6 in a state where the TE-mode dielectric core portion 12 is arranged at a predetermined position, the relative position of the TE-mode dielectric core portion 12 with respect to the TM-mode dielectric core portion 11 is determined.

According to the arrangement thus made to allow the relative position of the TE-mode dielectric core portion 12 to be shifted in the z-axis direction with respect to the TM-mode dielectric core portion 11, the intensity of coupling between a TMx mode and a TEy mode and coupling between a TMy mode and a TEx mode can be set in an arbitrarily wide range, and adjustment thereof can be implemented. In addition, according to the arrangement made to allow the position of the TM-mode dielectric core portion 11 to be shifted in the xy plane with respect to the TE-mode dielectric core portion 12 and the cavity 2, coupling between a TEz mode and either the TMx mode or the TMy mode can be arbitrarily set, and adjustment thereof can be implemented.

Figure 22A:
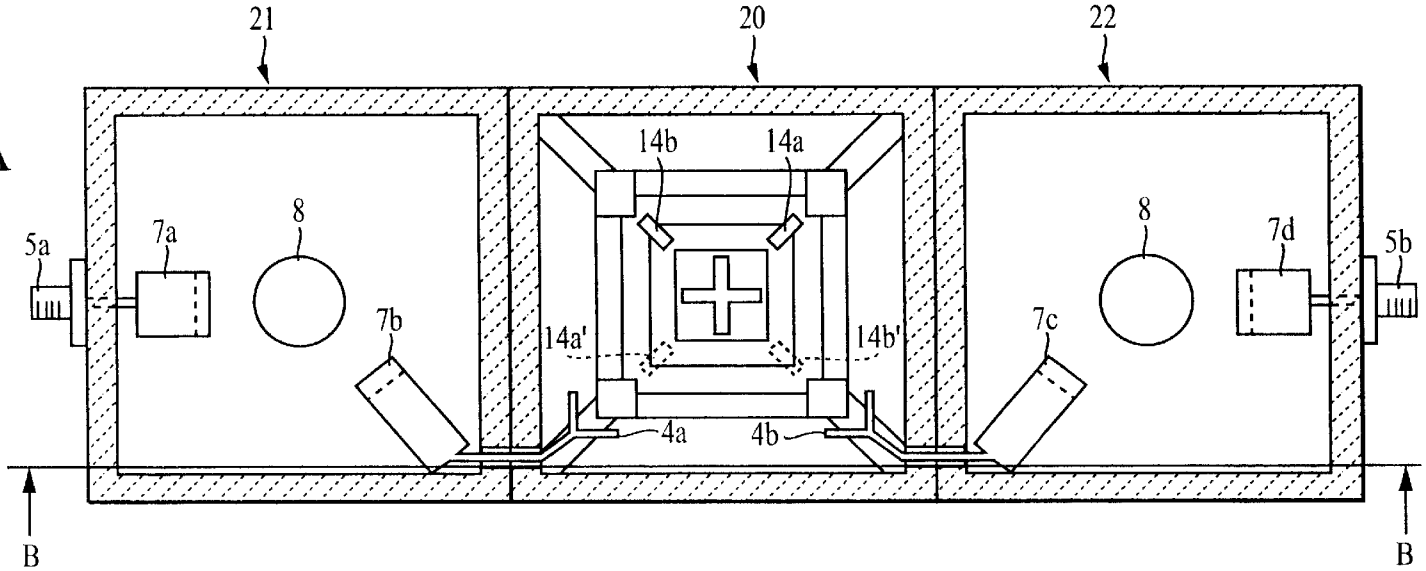
FIGS. 22A and 22B are views showing examples of configurations of filters individually using semicoaxial resonators and the quintuple mode resonator.
Figure 22B:
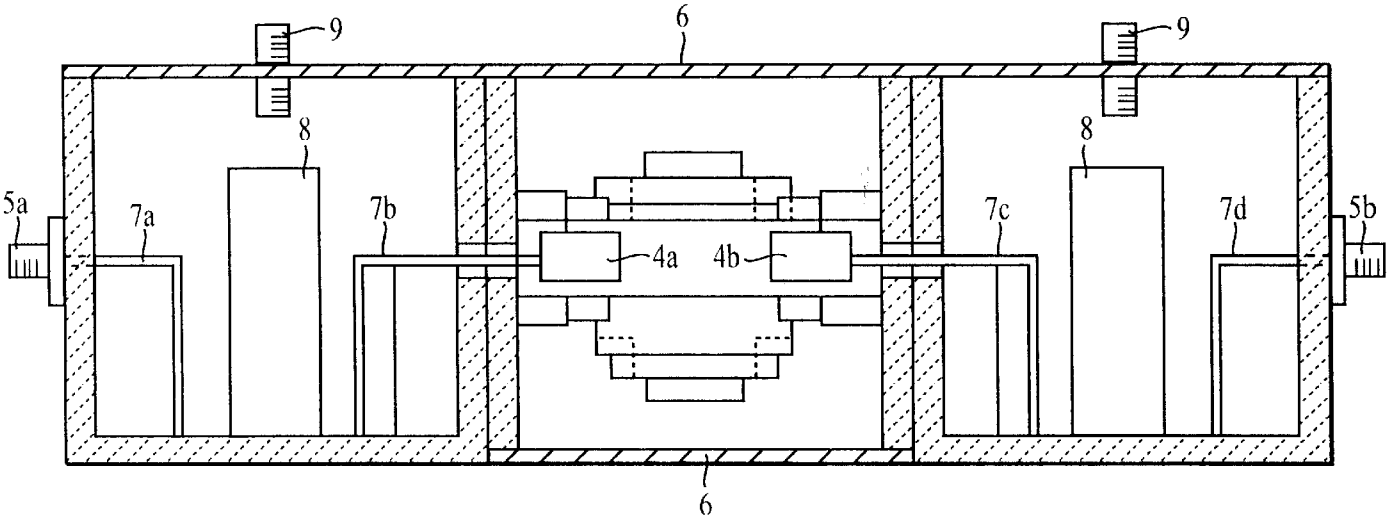

Hereinbelow, referring to FIGS. 22A and 22B, a description will be given of an example of a filter formed by adding other resonators in the multimode dielectric resonator apparatus. In FIGS. 22A and 22B, reference numeral 20 denotes a quintuple mode resonator. This resonator comprises the dielectric core of the quintuple mode resonator shown in FIGS. 15A and 15B, configured of a plate-like TM-mode dielectric core portion and a stepped-pyramid-like TE-mode dielectric core portion, and the input/output directions are rotated by 45 degrees in the xy plane. Therefore, quintuple resonant modes according to the TM-mode dielectric core portion 11 are coupled to each other in the order of TMx+y→TEx−y→TEz→TEx+y→TMx−y. Also, reference numerals 21 and 22 denote semicoaxial resonators 21 and 22. The individual semicoaxial resonators 21 and 22 have a central conductor 8 in a cavity, and the resonant frequency is determined according to electrostatic capacitance generated between a lower end portion of a frequency adjusting screw 9 and an upper end portion of the central conductor 8, the length of the central conductor 8, and the like. A coupling loop 7*a* is provided between a central conductor of a coaxial connector 5*a* and an inner face of the cavity, and external coupling is made through the coupling loop 7*a*. Similarly, a coupling loop 7*d* is provided between a central conductor of a coaxial connector 5*b* and an inner face of the cavity, and external coupling is made through the coupling loop 7*b*. Coupling loops 7*b* and 7*c* are connected to the probes 4*a* and 4*b*, respectively; and the coupling loops 7*b* and 7*c* are coupled by magnetic field to the semicoaxial resonators 21 and 22, respectively.

The above-described configuration, which has first and last resonator stages and five dielectric resonator stages therebetween, operates as a filter that has a total of seven resonator stages and that has band-pass characteristics. As described above, since the first and last stages of resonators are the semicoaxial resonators, and secure coupling can be obtained by the coupling loops, broadband characteristics can be easily obtained. In addition, since the spurious mode due to the quintuple mode resonator 20 is minimized by the semicoaxial resonators 21 and 22, the overall spurious characteristics can be decreased. Furthermore, since direct coupling to the outside is not necessary, the probes 4*a* and 4*b* in the quintuple mode resonator 20 can be miniaturized, direct passage of signals between the input and the output is reduced, and deterioration in characteristics because of the direct passage is therefore not caused.

In the example shown in FIGS. 22A and 22B, although semicoaxial resonators are used, coaxial resonators can similarly be used for the first stage and the last stage. In this case, effects similar to the above can be produced.

Hereinbelow, referring to FIG. 23, a description will be given of an example of a duplexer.

Figure 23:
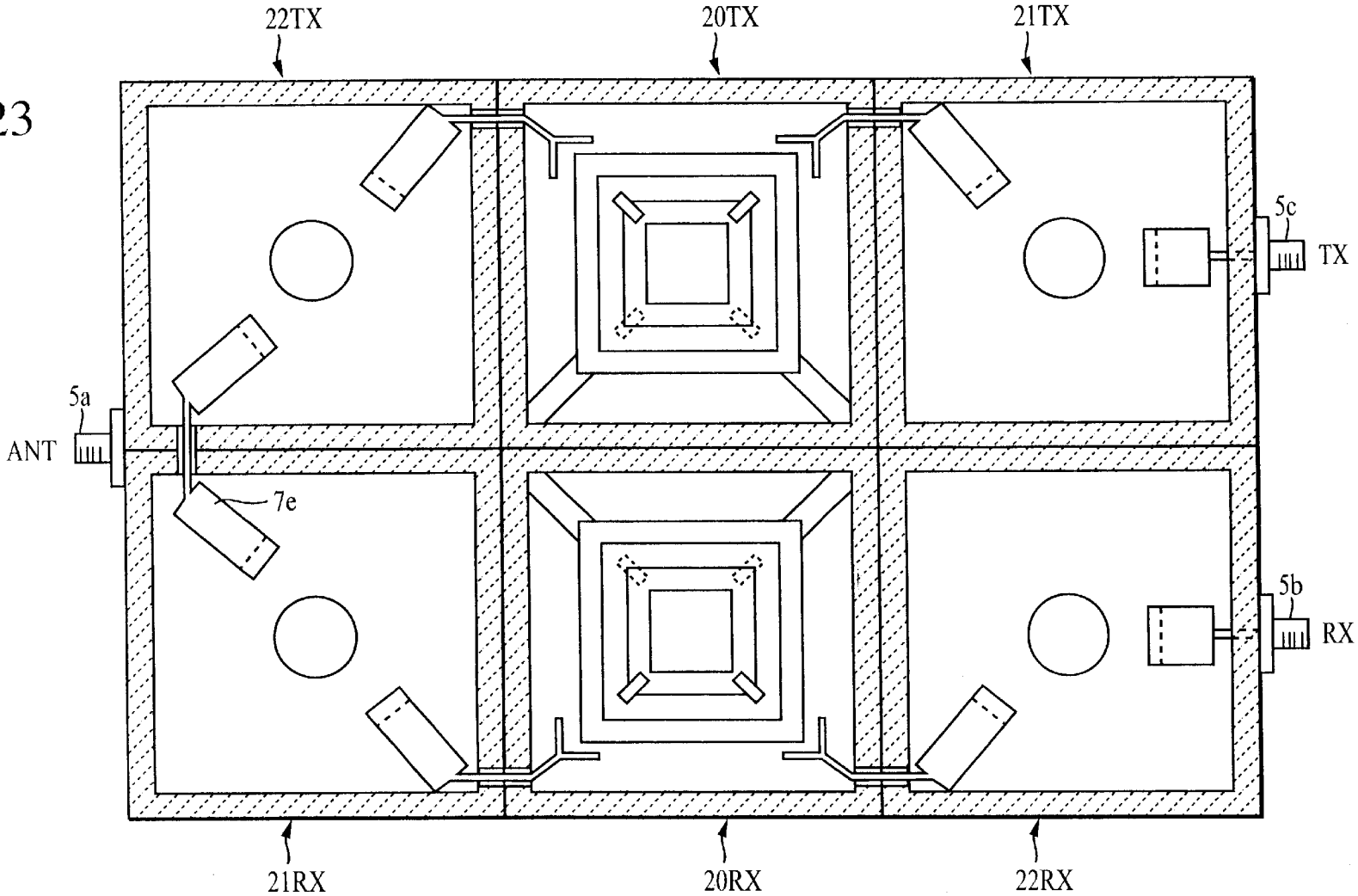
FIG. 23 shows an example of a configuration of a duplexer.

In FIG. 23, reference symbols 20TX and 20RX individually denote quintuple mode resonators that are similar to those shown in FIGS. 22A and 22B; and reference symbols 21TX, 22TX, 21RX, and 22RX individually denote semicoaxial resonators that are similar to those shown in FIGS. 22A and 22B. By the two semicoaxial resonators 21TX and 22TX and the quintuple mode resonator 20TX, a transmission filter portion is configured; and similarly, by the two semicoaxial resonators 21RX and 22RX and the quintuple mode resonator 20RX, a reception filter portion is configured.

Coupling loops 7*e* connected to a central conductor of a coaxial connector 5*a* are individually coupled by a magnetic field to the semicoaxial resonators 22TX and 21RX, and transmission signals and reception signals are thereby separated. Thus, the duplexer is configured as an antenna-sharing apparatus.

Figure 24:
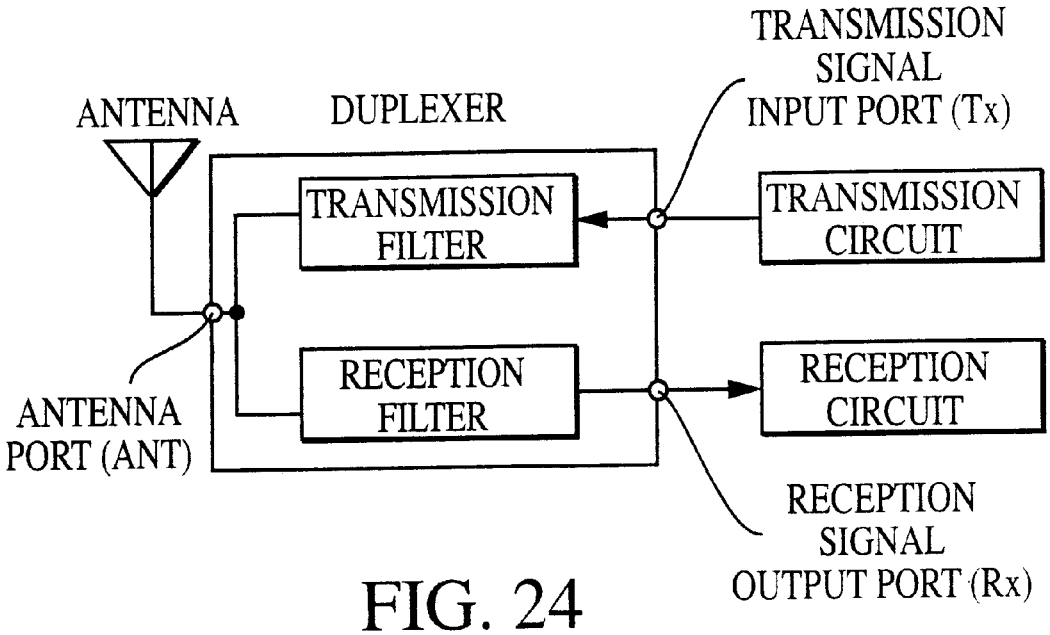
FIG. 24 is a block diagram showing a configuration of a communication apparatus.

FIG. 24 is a block diagram showing a configuration of a communication apparatus in which the above-described duplexer is used. In this way, by connecting a transmission circuit and a reception circuit to an input port of the transmission filter and an output port of the reception filter, respectively, and by connecting an antenna to the input and output ports of the duplexer, a high frequency section of the communication apparatus is configured.

In addition to these examples, the above-described quintuple mode resonator may be provided as an independent bandpass filter.

The individual embodiments are examples of filters in which the TMx mode and the TMy mode are generated in the square plate-like portion of the dielectric core and both are used. However, the arrangement may be such that, by making the TM-mode portion in a rectangular plate-like shape, for example, only the TMx mode may resonate in an operating frequency band, the resonant frequencies of the TMy mode and the TMz mode may be higher than the operating frequency band, and thus, only the single TM mode is used. Also, although the three TE modes are used in the embodiments, the arrangement may be such that only two TE modes thereof are used.

Although the present invention has been described in relation to particular embodiments thereof, many other variations and modifications and other uses will become apparent to those skilled in the art. Therefore, the present invention is not limited by the specific disclosure herein.

What is claimed is:

1. A multimode dielectric resonator apparatus comprising a dielectric core arranged in a conductive cavity, the dielectric core comprising:

a TM-mode dielectric core portion which determines resonant frequencies of TM modes so that at least one TM mode resonates in an operating frequency band; and a TE-mode dielectric core portion which determines resonant frequencies of TE modes so that multiple TE modes resonate in the operating frequency band, wherein an asymmetry exists in the relative arrangement of the TM-mode dielectric core portion and the TE-mode dielectric core portion and the support structures therefor, whereby predetermined TM and TE modes are coupled to each other so that, in an area where an electric field of a predetermined TM-mode is distributed, a TE-mode electric field having the same directional components as those of the TM modes electric fields are generated.

2. A multimode dielectric resonator apparatus as stated in claim 1, wherein the TM-mode dielectric core portion is formed to have a plate-like shape, the TE-mode dielectric core portion is formed to have a shape protruding from an upper face and a lower face of the plate-like portion, and the asymmetry is provided by a difference between the upper-side protruding amount and the lower-side protruding amount.

3. A multimode dielectric resonator apparatus as stated in claim 1, wherein dielectric members for supporting the TM-mode dielectric core portion and the TE-mode dielectric core portion in the cavity are arranged asymmetrically with respect to the TM-mode dielectric core.

4. A multimode dielectric resonator apparatus as stated in claim 1, wherein the TM-mode dielectric core portion and the TE-mode dielectric core portion are independently supported in the cavity, and the position of at least one of the dielectric core portions is adjustable.

5. A multimode dielectric resonator apparatus as stated in claim 1, wherein the TM-mode dielectric core portion is formed to have a plate-like shape, the TE-mode dielectric core portion is formed to have a shape protruding from an upper face and a lower face of the plate-like portion, and the TE-mode dielectric core portion is provided in a position deviating from the center of the TM-mode dielectric core portion, in the direction of the surface of the plate-like portion, thereby imparting the asymmetry.

6. A multimode dielectric resonator apparatus as stated in claim 1, wherein the TM-mode dielectric core portion is formed to have a plate-like shape, the TE-mode dielectric core portion is formed to have a shape protruding from an upper face and a lower face of the plate-like portion, and the dielectric core is provided in a position deviating from the center of the cavity in the direction of the surface of the TM-mode dielectric core portion, thereby imparting the asymmetry.

7. A filter comprising:

the multimode dielectric resonator apparatus as defined in one of claims 1 to 6, and input/output connectors coupled to predetermined resonant modes in the multimode dielectric resonator apparatus.

8. A communication apparatus comprising the filter as defined in claim 7, and further comprising one of a transmitting circuit and a receiving circuit connected to said filter.

9. A duplexer comprising first and second filters, each being a filter according to claim 7, and each filter having an input connector and an output connector;

the input connector of the first filter serving as a transmitter input terminal, the output connector of the second filter serving as a receiver output terminal, and the output connector of the first filter and the input connector of the second filter being connected in common to an antenna terminal.

10. A communication apparatus comprising the duplexer as defined in claim 9, and further comprising a transmitting circuit connected to said transmitter input terminal, and a receiving circuit connected to said receiver output terminal.

11. A filter comprising:

the multimode dielectric resonator apparatus as defined in one of claims 1 to 6, coaxial resonators or semicoaxial resonators that are coupled to predetermined modes of said multimode dielectric resonator apparatus, and input/output connectors coupled to the coaxial or semicoaxial resonators.

12. A duplexer comprising first and second filters, each being a filter according to claim 11, and each filter having an input connector and an output connector;

the input connector of the first filter serving as a transmitter input terminal, the output connector of the second filter serving as a receiver output terminal, and the output connector of the first filter and the input connector of the second filter being connected in common to an antenna terminal.

13. A communication apparatus comprising the duplexer as stated in claim 12, and further comprising a transmitting circuit connected to said transmitter input terminal, and a receiving circuit connected to said receiver output terminal.

14. A communication apparatus comprising the filter as defined in claim 11, and further comprising one of a transmitting circuit and a receiving circuit connected to said filter.

* * * * *